US012668966B2

(12) United States Patent
Scrafford et al.

(10) Patent No.: US 12,668,966 B2
(45) Date of Patent: Jun. 30, 2026

(54) MODULAR SPACE FRAME SUPPORT SYSTEM, WORK PLATFORM SYSTEM AND METHODS OF ERECTING THE SAME

(71) Applicant: BrandSafway Services, LLC, Atlanta, GA (US)

(72) Inventors: Roy T. Scrafford, Scotia, NY (US); Alana Martalock, Flushing, NY (US); Jerry Dolly, Flushing, NY (US); Paul Jolicoeur, Troy, NY (US); Scott Tomlinson, Flushing, NY (US); Jonathan Burkhart, Flushing, NY (US); Mathieu Grumberg, Delmar, NY (US)

(73) Assignee: BrandSafway Services, LLC, Atlanta, GA (US)

( * ) Notice: Subject to any disclaimer, the term of this patent is extended or adjusted under 35 U.S.C. 154(b) by 663 days.

(21) Appl. No.: 18/005,523

(22) PCT Filed: Jul. 16, 2020

(86) PCT No.: PCT/US2020/042386

§ 371 (c)(1),
(2) Date: Jan. 13, 2023

(87) PCT Pub. No.: WO2022/015315

PCT Pub. Date: Jan. 20, 2022

(65) Prior Publication Data

US 2023/0265645 A1 Aug. 24, 2023

(51) Int. Cl.
*E04B 1/19* (2006.01)

(52) U.S. Cl.
CPC .... *E04B 1/1909* (2013.01); *E04B 2001/1918* (2013.01); *E04B 2001/1933* (2013.01);
(Continued)

(58) Field of Classification Search
CPC ..... E04B 1/1909; E04B 2001/1918; E04B 2001/1933; E04B 2001/1963; E04B 2001/1984; E04C 2003/0491
(Continued)

(56) References Cited

U.S. PATENT DOCUMENTS 3,948,012 A 4/1976 Papayoti
4,026,079 A 5/1977 Morris
(Continued)

FOREIGN PATENT DOCUMENTS

CL 199200184 A 5/1993
CL 60899 11/2020
(Continued)

OTHER PUBLICATIONS

International Search Report and Written Opinion of International Application No. PCT/US2019/013658, dated Apr. 12, 2019, 11 pages.
(Continued)

*Primary Examiner* — Christine T Cajilig
(74) *Attorney, Agent, or Firm* — Foley & Lardner LLP

(57) ABSTRACT

A modular space frame support system comprises at least one unit comprising at least four elongate structural members joined together using at least four interconnection structures; a plurality of diagonal chords attached to the at least four interconnection structures and connected to a single common interconnection structure; a further elongate structural member connected to and secured to at least two elongate structural members; wherein the plurality of diagonal chords of a first of the at least one unit can each have a length less than the plurality of diagonal chords of a second of the at least one unit; wherein each of the at least four interconnection structures comprise a first element, a second element, and a tubular section; wherein the tubular section
(Continued)

can have a threaded inner portion, a first outer portion, and a second outer portion that can engage a securing structure.

35 Claims, 23 Drawing Sheets

(52) U.S. Cl.
CPC ..... *E04B 2001/1963* (2013.01); *E04B 2001/1984* (2013.01)

(58) Field of Classification Search
USPC ..... 52/648.1, 655.1
See application file for complete search history.

(56) References Cited

U.S. PATENT DOCUMENTS

| | | | | |
|---|---|---|---|---|
| 4,211,044 | A | 7/1980 | Gugliotta et al. | |
| 4,483,118 | A | 11/1984 | Betschart | |
| 4,641,477 | A | 2/1987 | Schleck | |
| 4,746,056 | A | 5/1988 | Thomsen | |
| 5,203,428 | A | 4/1993 | Beeche | |
| 5,214,899 | A * | 6/1993 | Beeche | E04B 1/19 52/648.1 |
| 5,498,093 | A | 3/1996 | Imai | |
| 6,223,482 | B1 * | 5/2001 | Zohar | E04H 15/50 52/645 |
| 6,321,502 | B1 | 11/2001 | Castano | |
| 7,779,599 | B2 | 8/2010 | Jolicoeur et al. | |
| 9,976,264 | B2 | 5/2018 | Grumberg et al. | |
| 10,465,396 | B2 | 11/2019 | Apostolopoulos et al. | |
| 2005/0217936 | A1 * | 10/2005 | Jolicoeur | E04G 1/34 182/130 |
| 2013/0333320 | A1 | 12/2013 | Reynolds et al. | |
| 2014/0230360 | A1 | 8/2014 | Naito | |
| 2014/0262619 | A1 | 9/2014 | Bains | |
| 2015/0041252 | A1 | 2/2015 | Grumberg et al. | |
| 2016/0115697 | A1 | 4/2016 | Shaw | |
| 2017/0198484 | A1 * | 7/2017 | Grumberg | E04G 21/30 |
| 2017/0254099 | A1 * | 9/2017 | Grumberg | E04G 7/20 |

FOREIGN PATENT DOCUMENTS

| | | | | |
|---|---|---|---|---|
| DE | 102013102492 | A1 | 9/2014 | |
| EP | 0 460 004 | B1 | 12/1993 | |
| FR | 2618818 | A1 * | 2/1989 | E04B 1/1909 |
| GB | 2072297 | A * | 9/1981 | E04B 1/1909 |
| JP | 2002-371625 | A | 12/2002 | |
| JP | 2010-007385 | A | 1/2010 | |
| WO | 2014184750 | A1 | 11/2014 | |
| WO | 2016059574 | A1 | 4/2016 | |
| WO | 2019143615 | A1 | 7/2019 | |

OTHER PUBLICATIONS

International Search Report and Written Opinion for International Application No. PCT/US2020/042386, dated Oct. 16, 2020, 24 pages.

* cited by examiner

MODULAR SPACE FRAME SUPPORT SYSTEM, WORK PLATFORM SYSTEM AND METHODS OF ERECTING THE SAME

FIELD OF THE DISCLOSURE

This disclosure relates to space frame assemblies which may be used as building components in forming floors, roofs, and walls, or as work platform and access systems such as for construction and maintenance of buildings, bridges and other structures. More particularly, this disclosure relates to a system of modular components which may be assembled to provide space frames which can be readily adapted to a variety of sizes and configurations.

BACKGROUND OF THE INVENTION

There are many applications in the building industry where an easy to assemble and disassemble space frame assembly is desirable. Some examples are temporary floors, walls, and roofs, and the work platform systems employed to perform construction and maintenance tasks on various portions of buildings, bridges and other structures. Space frame assemblies which have been employed in the past have typically been constructed so that the task involved could be performed on one portion of a building or structure at a time.

Work platform systems using modular components have previously been introduced, including, for example, U.S. Pat. No. 5,214,899, which provides a modular space frame utilizing a limited number of interchangeable components to form frame assemblies of various sizes and configurations. Such modular work platforms, however, are labor intensive to assemble. Further, such platforms are generally designed to use the minimum number of components necessary to achieve a desired maximum capacity. However, in some cases, only a portion of a platform will experience a particularly high load.

Therefore, in view of the foregoing, it would be advantageous to provide a space frame system, work platform system or other structure that addresses one or more of the above deficiencies or other problems.

SUMMARY

In accordance with at least some embodiments of the present disclosure, it is advantageous to provide a space frame which is usable in a wide variety of applications.

In accordance with at least some embodiments of the present disclosure, it is advantageous to provide a space frame which utilizes a limited number of interchangeable components to form space frame assemblies and work platform systems of various sizes and configurations.

In accordance with at least some embodiments of the present disclosure, provided herein is a modular space frame support system comprising: at least one unit of a modular space frame support system, the at least one unit comprising: at least four elongate structural members, wherein a first and a second of the at least four elongate structural members form a first pair of opposed elongate structural members and a third and a fourth of the elongate structural members form a second pair of opposed elongate structural members, the first and second pairs of opposed elongate structural members joined together using at least four interconnection structures to define a substantially rectangular planar surface; a plurality of diagonal chords attached to a respective one of each of the at least four interconnection structures at a first end and each connected to a single common interconnection structure at a second end; at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to at least one of the first pair of opposed elongate structural members along first and second opposed edges, to one of the other of the pair of opposed elongate structural members, and the at least one further elongate structural member so as to at least partially cover the rectangular planar surface.

In accordance with at least some embodiments of the present disclosure, provided herein is a modular space frame support system comprising: at least two units of a modular space frame support system, each unit comprising: at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface; a plurality of diagonal chords attached to a respective one of each of the at least four interconnection structures at a first end and each connected to at least one further interconnection structure at a second end; at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to cover at least a portion of the rectangular planar surface, wherein the deck platform of each of the at least two units is coplanar, and wherein the plurality of diagonal chords of a first of the at least two units each have a length less than the plurality of diagonal chords of a second of the at least two units.

In accordance with at least some embodiments of the present disclosure, provided herein is an interconnection structure comprise: a first element being generally planar; a second element being generally planar, wherein the first element and second element are generally parallel to one another; and a tubular section between the first element and second element, the tubular section having a hollow, smooth interior and providing a continuous passage through the first element and the second element.

In accordance with at least some embodiments of the present disclosure, provided herein is a modular space frame support system comprising: at least one unit of a modular space frame support system, the at least one unit comprising: at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface; a plurality of diagonal chords attached to a respective one of each of the at least four interconnection structures at a first end and each connected to at least one further interconnection structure at a second end; at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to at least partially cover the rectangular planar surface; wherein each of the at least four interconnection structures comprise: a first element being generally planar; a second element being generally planar, wherein the first element and second element are generally parallel to one another; and a tubular section between the first element and second element, the tubular section having a hollow, smooth interior and providing a continuous passage through the first element and the second element.

In accordance with at least some embodiments of the present disclosure, provided herein is a modular space frame support system comprising: at least two units of a modular space frame support system, each unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface; a plurality of diagonal chords attached to a respective one of each of the at least four interconnection structures at a first end and each connected to at least one further interconnection structure at a second end; at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to cover at least a portion of the rectangular planar surface, wherein the deck platform of each of the at least two units is coplanar, wherein the plurality of diagonal chords of a first of the at least two units each have a length less than the plurality of diagonal chords of a second of the at least two units, and wherein each of the at least four interconnection structures comprise: a first element being generally planar; a second element being generally planar, wherein the first element and second element are generally parallel to one another; and a tubular section between the first element and second element, the tubular section having a hollow, smooth interior and providing a continuous passage through the first element and the second element.

Figure 1:
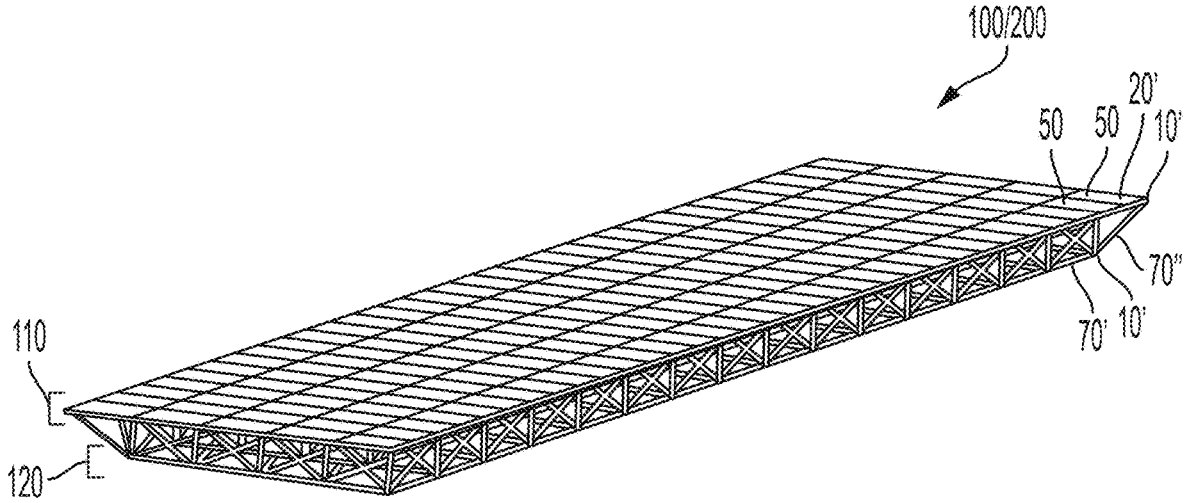
FIG. 1 is an isometric view of an exemplary embodiment of a modular space frame support system forming a work platform system, in accordance with embodiments of the present disclosure.

Although certain preferred embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

DETAILED DESCRIPTION

As a preface to the detailed description, it should be noted that, as used in this specification and the appended claims, the singular forms "a", "an" and "the" include plural referents, unless the context clearly dictates otherwise.

As used herein, the term "single section or unit of a modular space frame support system" and related phrases refers to a planar structure composed of at least three interconnection structures and a plurality of elongate structural members which connect the at least three interconnection structures to form a framework capable of supporting at least one planar deck platform. With respect to a "single section or unit of a modular space frame support system," the terms "section" and/or "unit" can be used interchangeably. Moreover, it will be appreciated that adjacent sections of units of a modular space frame support system may share one or more components, e.g., two adjacent sections of a modular space frame support system may share one or more interconnections structures and one elongate structural member or chord.

As used herein, the term "multi-level" and related phrases refers to a structure having two or more distinct sections separated by a vertical distance. Generally, each level of a "multi-level" structure will be approximately horizontal or in a generally horizontal plane.

The term "stress" refers to how much tension or compression a material or structure is subject to.

The term "span" refers to the distance between supports. When used in reference to a multi-level structure in which individual levels are generally horizontal or in a generally horizontal plane, a support is a generally vertically oriented structure between one or more levels of a multi-level structure or between one or more levels of a multi-level structure and an independent structure (e.g., building, bridge, etc.). As used herein, "supports" are generally vertical support members, diagonal chords, and suspension components, e.g., suspension connectors/suspension connector assemblies.

As used herein, the term "section" refers to a physical property of a structure, e.g., an elongated structure such as a beam, joist, chord, etc., which determines how much bending the structure can resist.

Figure 2:
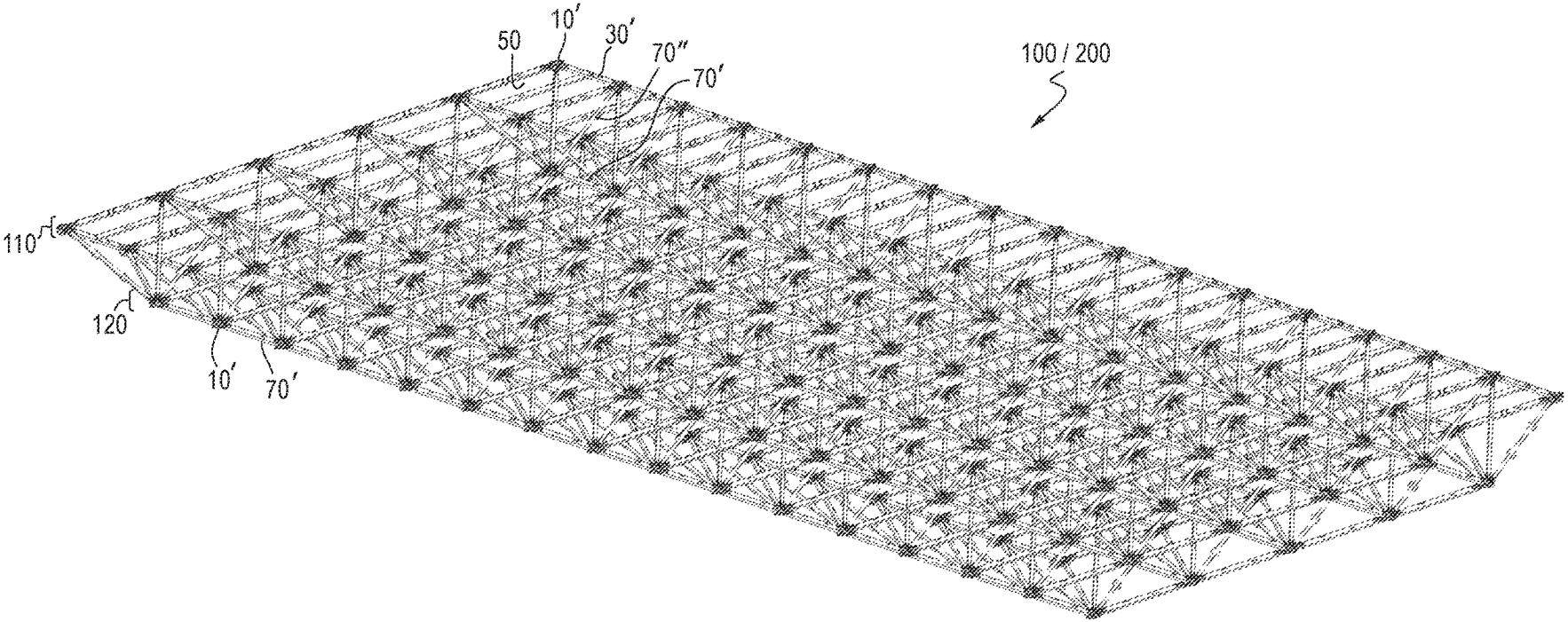
FIG. 2 is a bottom perspective view of the embodiment shown in FIG. 1, in accordance with embodiments of the present disclosure.

FIGS. 1 and 2 illustrate an exemplary embodiment of a framework which is a modular space frame support system 100 made of interconnection structures and elongate structural members extending horizontally and diagonally between the interconnection structures to create a framework for a plurality of deck platforms 50. The embodiment shown in FIGS. 1 and 2 has an upper framework level 110 and a lower framework level 120, each built from a plurality of interconnection structures 10' and upper and lower elongate structural members 30' and 70", respectively. The levels 110 and 120 are joined by diagonal elongate structural members 70'.

As FIGS. 1 and 2 depict, and as further supported by the description of the individual components, there is virtually no limit as to the size and shape of the modular space frame support system and work platform system that can be made in accordance with the present disclosure. FIGS. 1 and 2 show top and bottom perspective views, respectively, of one large rectangular embodiment of a modular space frame support system 100 with work platforms 50 in place to make a work platform system 200, though other general shapes and geometries are herein contemplated.

Interconnection Structure

FIGS. 3-8 illustrate an interconnection structures 10/10'. An interconnection structure is any structure which connects one or more elongate structural member, such as a node, post, column, center, shaft, or the like.

Figure 3:
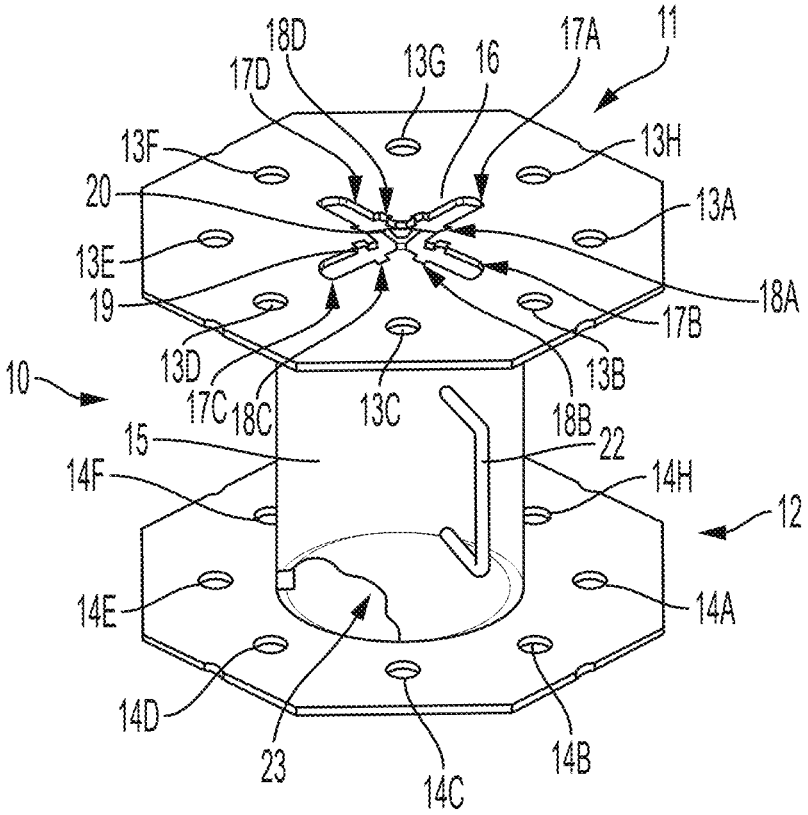
FIG. 3 is a top perspective view of an interconnection structure, in accordance with the present disclosure.
Figure 4:
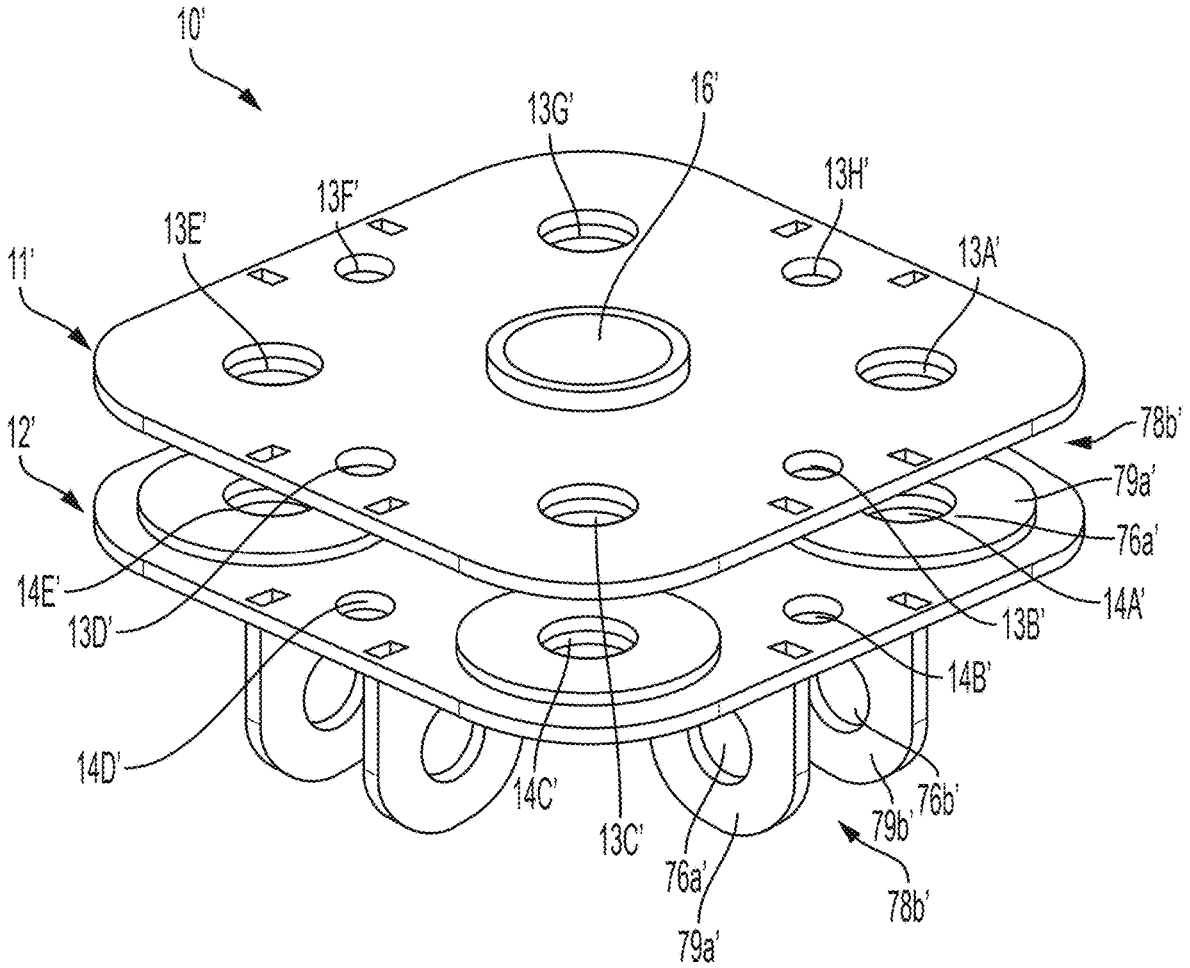
FIG. 4 is a top perspective view of a second embodiment of an interconnection structure, in accordance with the present disclosure.
Figure 5:
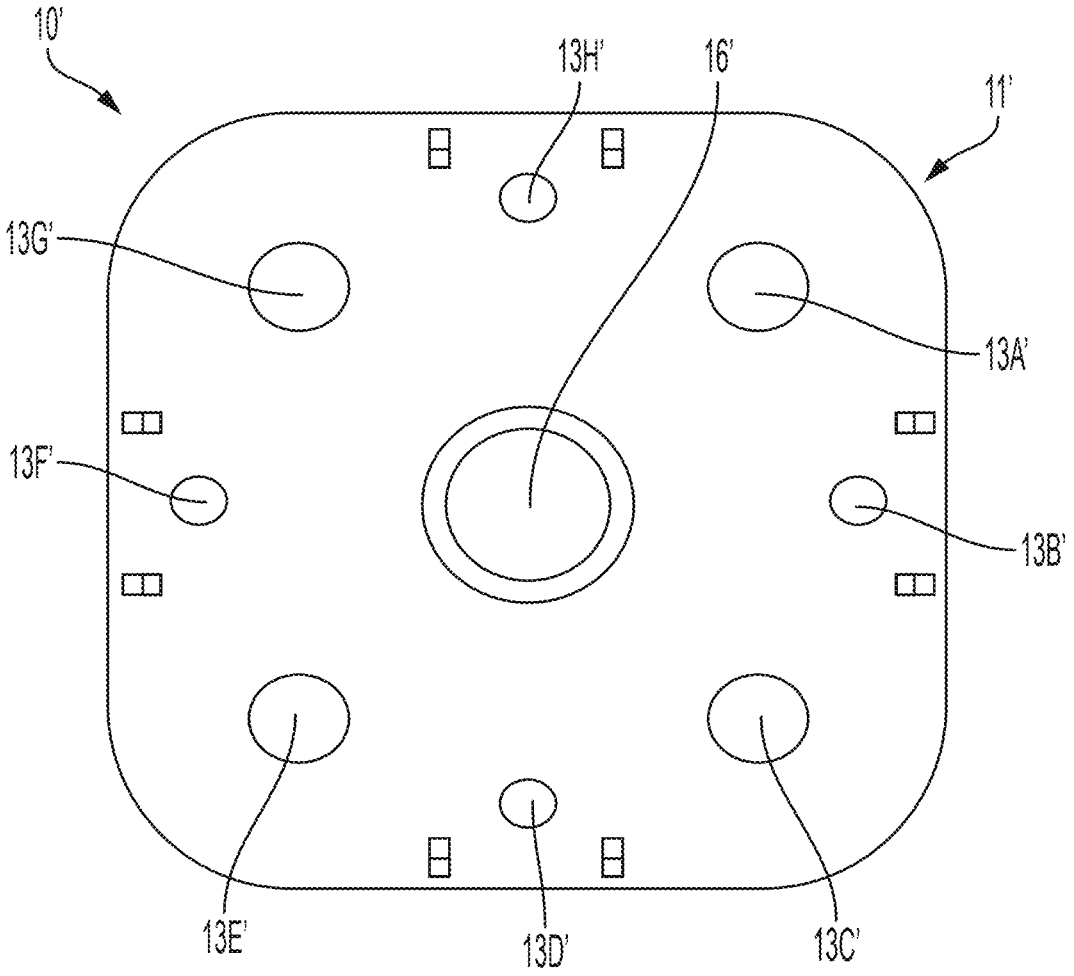
FIG. 5 is a top view of the interconnection structure of FIG. 4, in accordance with the present disclosure.
Figure 6:
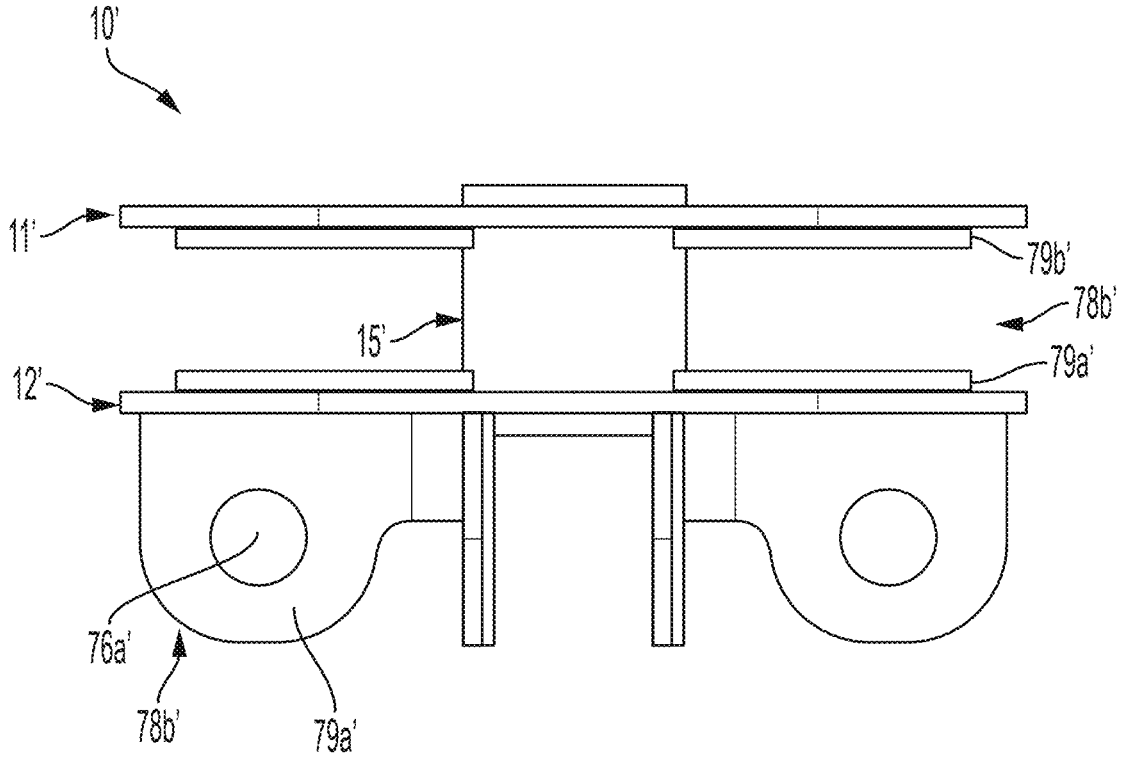
FIG. 6 is a side elevation view of the interconnection structure of FIG. 4, in accordance with the present disclosure.
Figure 7:
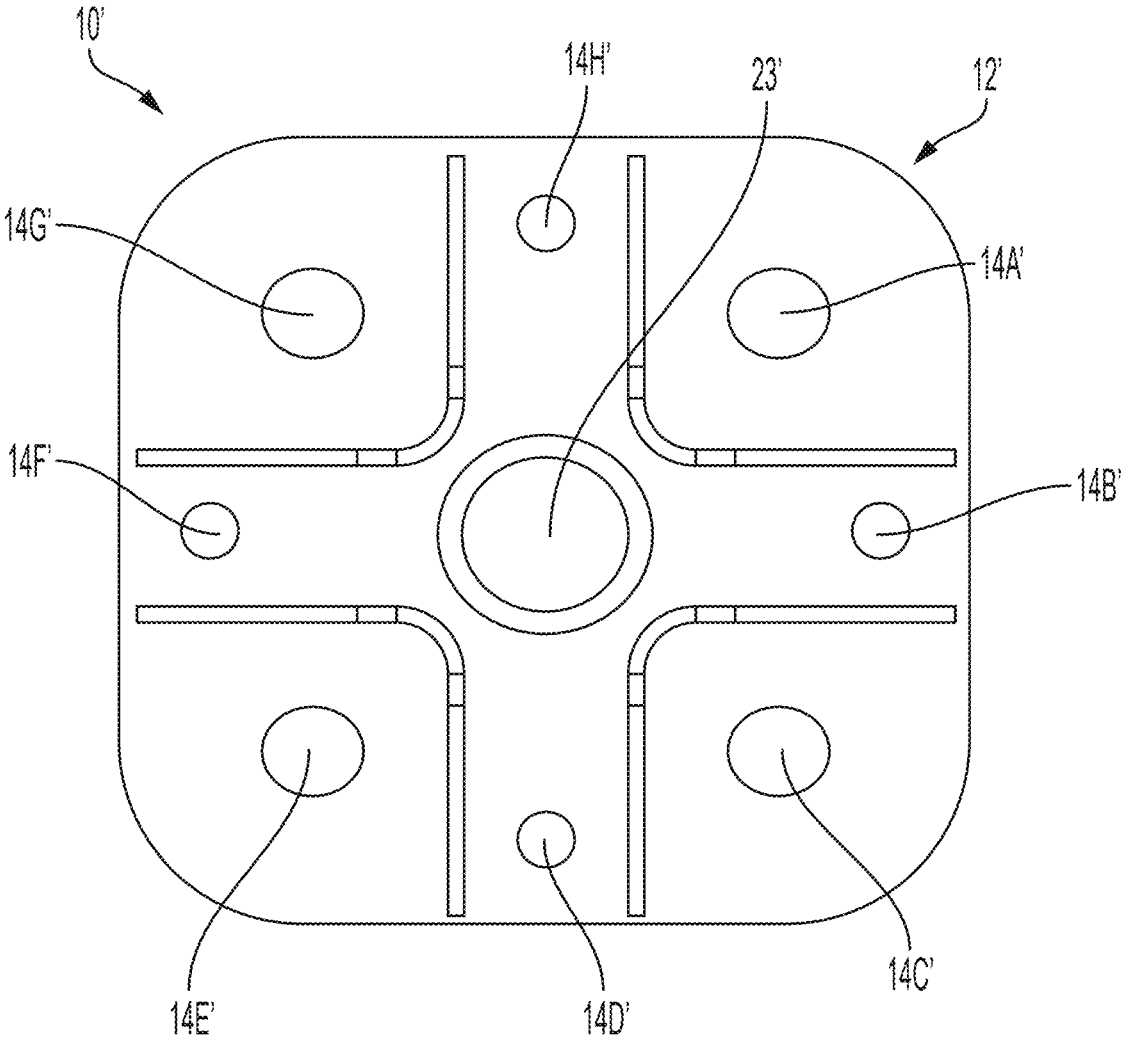
FIG. 7 is a bottom view of the interconnection structure of FIG. 4, in accordance with the present disclosure.

The exemplary interconnection structure 10 shown in FIG. 3 includes a top element 11 and a bottom element 12 spaced at distal ends of a middle section 15. The top element 11 and bottom element 12 may be substantially planar in configuration, as well as, being parallel to each other. The top element 11 and bottom element 12, in the embodiment shown, are octagonal in plan. The middle section 15 may be a cylindrical section wherein a longitudinal axis of the middle section 15 is normal to the planes of the top element 11 and bottom element 12. There are a plurality of openings 13, 14, extending through both the top element 11 and bottom element 12, respectively.

At the center of the top element 11 is a center opening 16. The center opening 16 may be generally cruciform in configuration due to its center opening area 19 with four slots 17 (e.g., 17A, 17B, 17C, 17D) extending therefrom. Transverse to each of the four slots 17A, 17B, 17C, 17D, and interconnected thereto, are a series of cross slots 18A, 18B, 18C, 18D. For added strength a second reinforcing plate 20 is added to the underside of the top element 11 wherein openings on the reinforcing plate 20 correspond to the center opening 16 configuration and all the ancillary openings thereto (17, 18, 19). A handle 22 is optionally added to the side of the middle section 15.

FIGS. 4-8 illustrate a second embodiment of an interconnection structure 10'. The interconnection structure 10' includes a first element 11' and a second element 12' spaced at distal ends of a tubular section 15'. The first element 11' and second element 12' may be substantially planar in configuration, as well as, being parallel to each other. The first element 11' and second element 12', in the embodiment shown, are generally square in plan. In other embodiments, the first element 11' and second element 12' can have other shapes, such as octagonal, polygonal, circular, etc.

The tubular section 15' may be a cylindrical section wherein a longitudinal axis of the tubular section 15' is normal to the planes of the first element 11' and second element 12'. The tubular section 15' can define a length and an inner diameter. In one embodiment, the length of the tubular section 15' may be less than the length of the middle section 15 of the interconnection structure 10.

The tubular section 15' can define a substantially uniform cross-section along its length. In the embodiment shown, the tubular section 15' is a right circular cylinder. However, in alternative embodiments, the tubular section 15' can have different shape, such as any prism having a polygonal face. The tubular section 15' can have a hollow interior.

There are a plurality of openings 13', 14', extending through both the first element 11' and second element 12', respectively. The plurality of openings 13' (e.g., 13A', 13B', 13C', 13D', 13E', 13F', 13G', 13H') are interspersed on the first element 11' so as to offer various locations for connecting to one, or more, elongate structural member 30'. The plurality of openings 14' (e.g., 14A', 14B', 14C', 14D', 14E', 14F', 14G', 14H') are similarly spaced on the second element 12' so that respective openings (e.g., 13A' and 14A') are coaxial.

At the center of the first element 11' is a center opening 16'. A corresponding opening 23' is shown at the center of the second element 12' in FIG. 7. In an embodiment, the center openings 16' and 23' receive a threaded cartridge 800 (see e.g., FIG. 8). In other embodiments, the center openings 16' and 23' receive an elongate structural member such as a vertical support member 75. The center openings 16' and 23' may be generally circular in configuration.

The interconnection structure 10' has one or more chord-engaging structures 78*b*' adapted to engage the end of an elongate structural member 30 or a chord 70. In accordance with one embodiment, the at least one chord-engaging structure 78*b*' includes two plates 79*a*', 79*b*' configured to engage the end of an elongate structural member 30 or a chord 70. Specifically, the plates 79*a*', 79*b*' each include an opening 76*a*', 76*b*' such that the openings 76*a*', 76*b*' are corresponding and coaxial to form a linear passage through the plates 79*a*', 79*b*'.

In one embodiment, in which the one or more chord-engaging structures 78*b*' adapted to engage the end of an elongate structural member 30 or a chord 70, are plates 79*a*', 79*b*', the plates 79*a*', 79*b*' can be generally arcuate in shape. In another embodiment, in which the one or more chord-engaging structures 78*b*' adapted to engage the end of an elongate structural member 30 or a chord 70, are plates 79*a*', 79*b*', the plates 79*a*', 79*b*' can be generally circular in shape. In such embodiments, the openings 76' can be positioned in the centers of the plates 79'. The openings 76' are set away from the second element 12' of the interconnection structure 10' at a distance. The particular shape and configuration of the plates 79*a*', 79*b*' can vary depending on the particular arrangement of the modular space frame support system and the specific design of the other components used. For example, while the plates 79*a*', 79*b*' described herein are generally arcuate or circular, in other embodiments, the plates 79*a*', 79*b*' can take different polygonal shapes or even a circular or triangular shape. In still further embodiments, the openings 76*a*', 76*b*' can be positioned at a different spot on the plates 79*a*', 79*b*'. In particular, in one alternative embodiment, the plates 79*a*', 79*b*' may be symmetrical.

Figure 8:
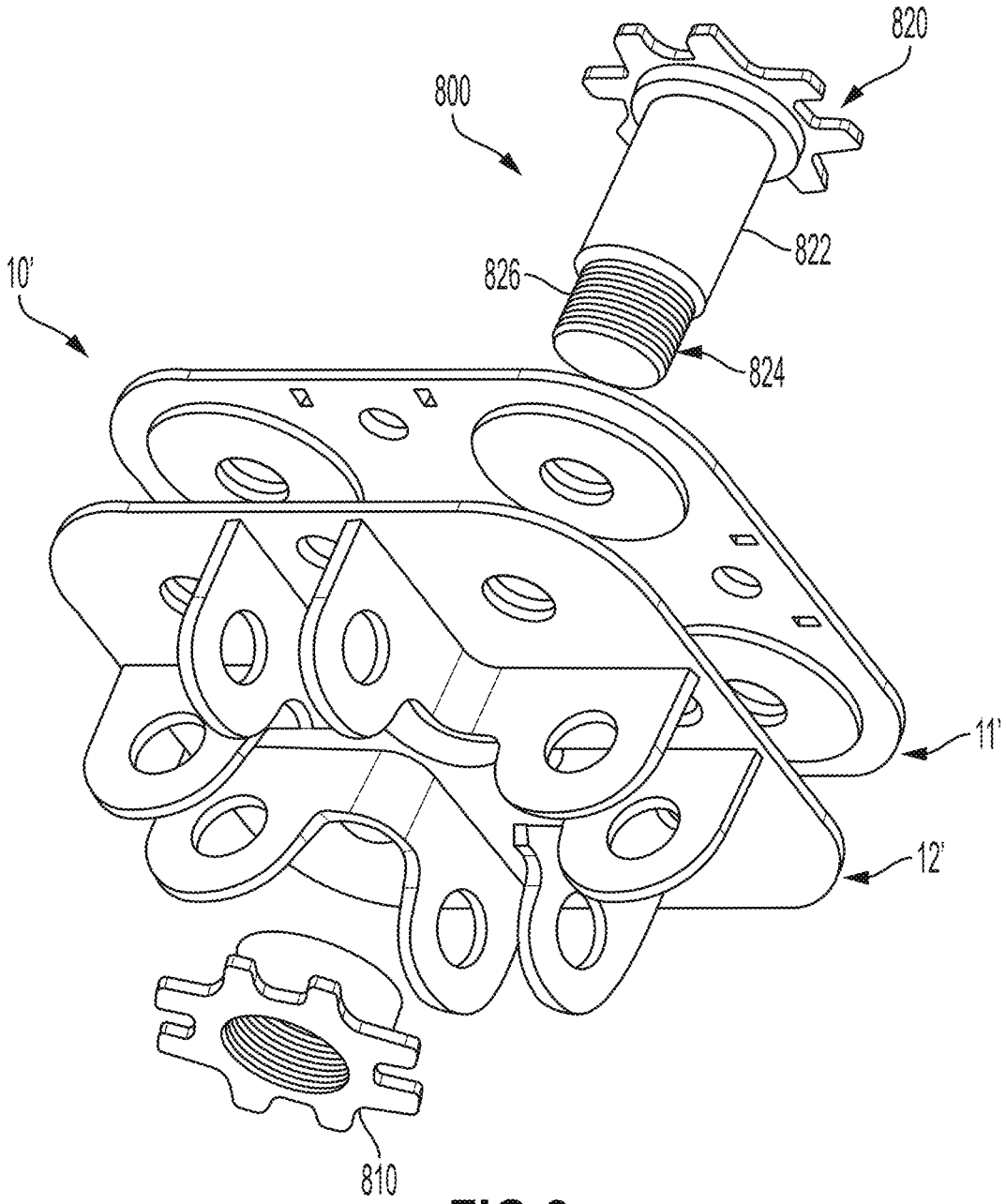
FIG. 8 is a bottom perspective view of the interconnection structure of FIG. 4 with a threaded cartridge, in accordance with the present disclosure.

As shown in FIG. 8, the interconnection structure 10' can utilize a securing structure 810 corresponding with a threaded cartridge 800. The threaded cartridge 800 has a tubular member 820 with a first outer portion 822 and a second outer portion 824. The threaded cartridge 800 may further comprise a threaded inner portion 826 (not shown). As shown in FIG. 8, the first outer portion 822 is generally smooth, and the second outer portion 824 has a securing structure-engaging structure 826, which in the embodiment shown is a threaded surface. The first outer portion 822 defines a length and an outer diameter. The length and outer diameter of the first outer portion 822 correspond to the length and inner diameter of the tubular section 15', such that when the threaded cartridge 800 is inserted into the tubular section 15', the second outer portion 824 is exposed beyond either the first element 11' or the second element 12' and capable of engaging the securing structure 810.

Elongate Structural Members

"Elongate structural member" refers to any generally linear length of material which can be connected with an interconnection structure to build a framework for a modular space frame support system. Elongate structural members can take several forms and, in some embodiments, elongate structural members may be specifically designed for horizontal, diagonal and/or vertical use. Further still, in some embodiments, horizontal elongate structural members may be specific to the upper or lower framework. In an alternative embodiment, a single elongate structural member may be configured to be used universally in a framework, i.e., as two or more of a horizontal, vertical, and diagonal elongate structural members.

Figure 9:
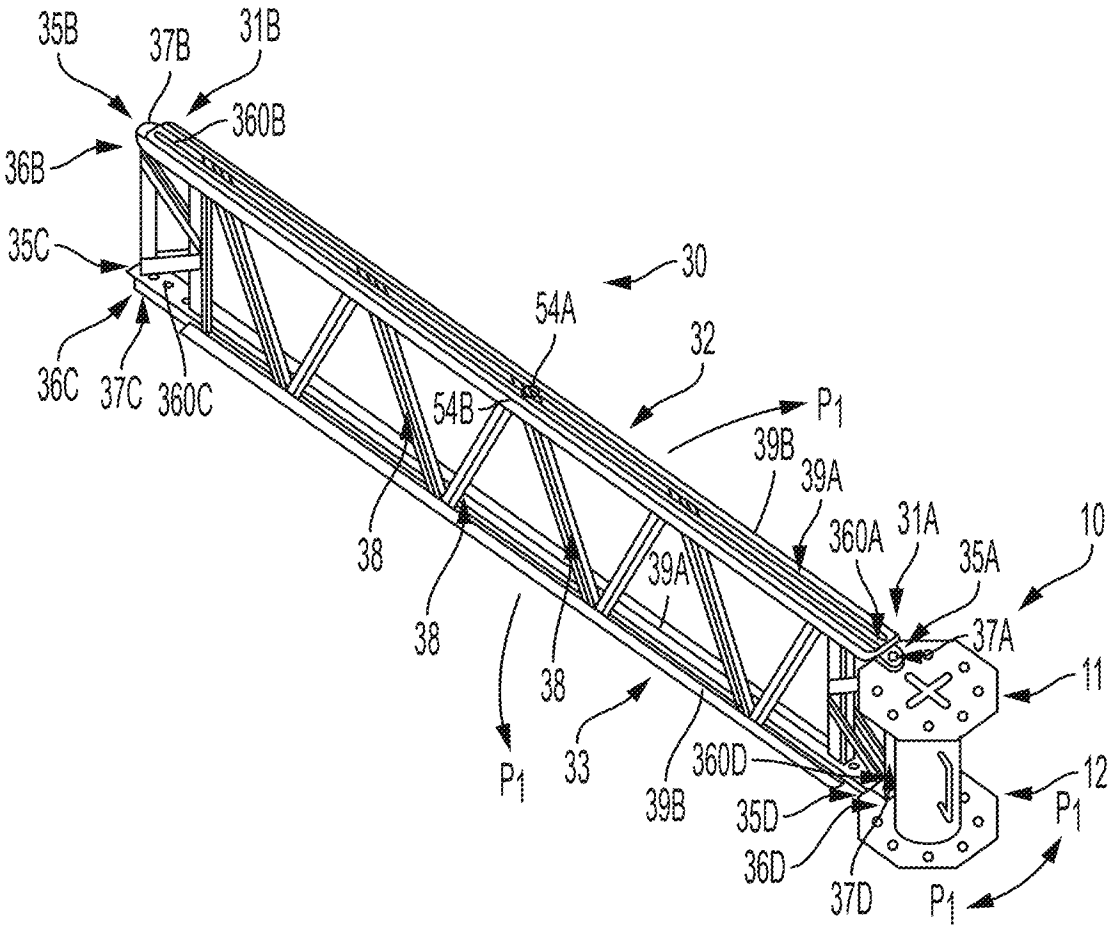
FIG. 9 is a top perspective view of an interconnection structure and an exemplary elongate structural member, in accordance with the present disclosure.
Figure 10:
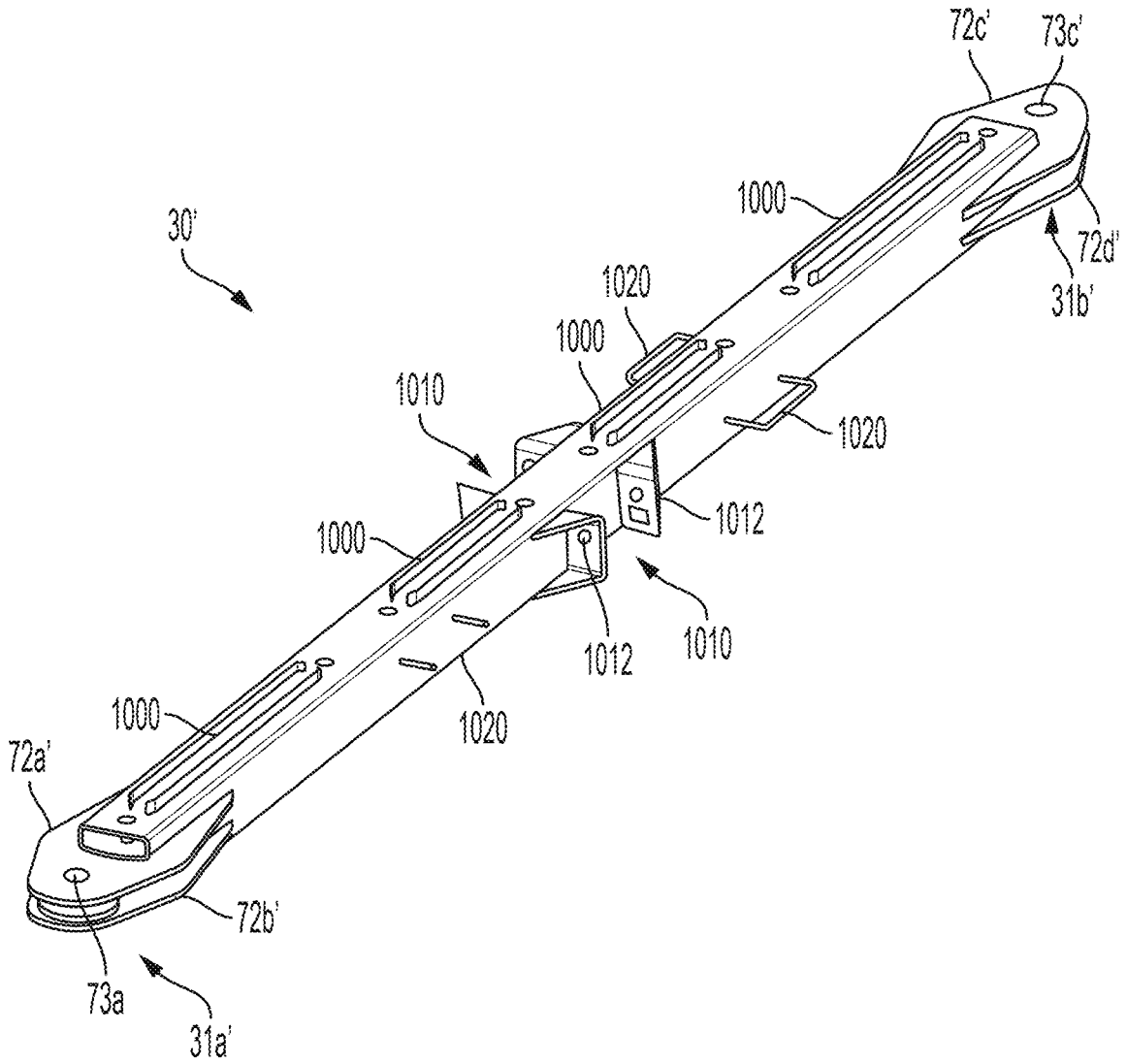
FIG. 10 is a top perspective view of a second embodiment of an elongate structural member, in accordance with the present disclosure.
Figure 11:
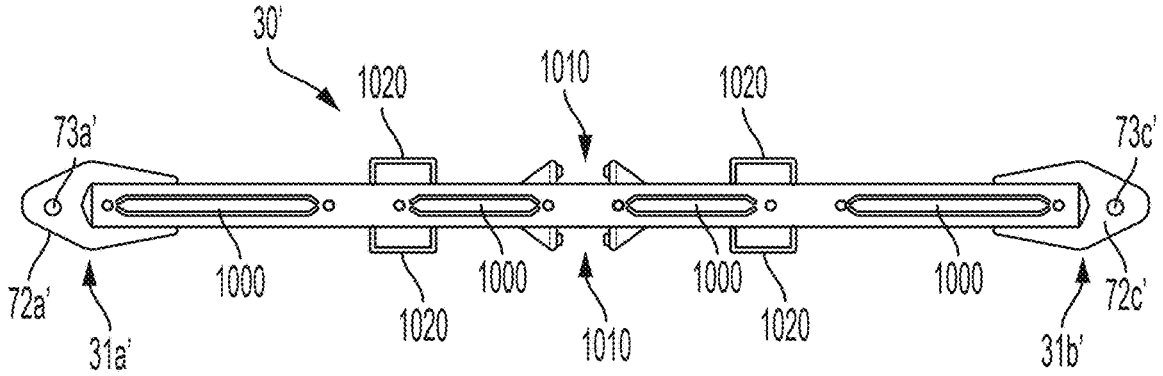
FIG. 11 is a top view of the elongate structural member of FIG. 10, in accordance with the present disclosure.
Figure 12:
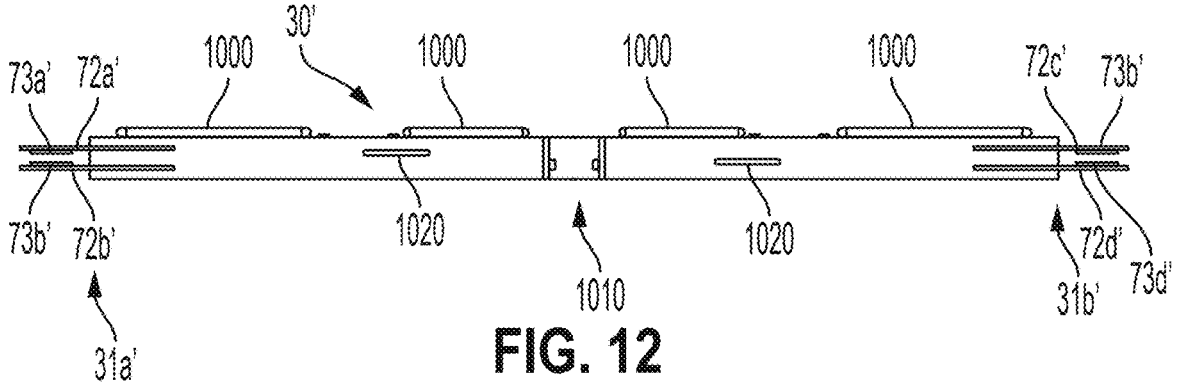
FIG. 12 is a side elevation view of the elongate structural member of FIG. 10, in accordance with the present disclosure.
Figure 13:
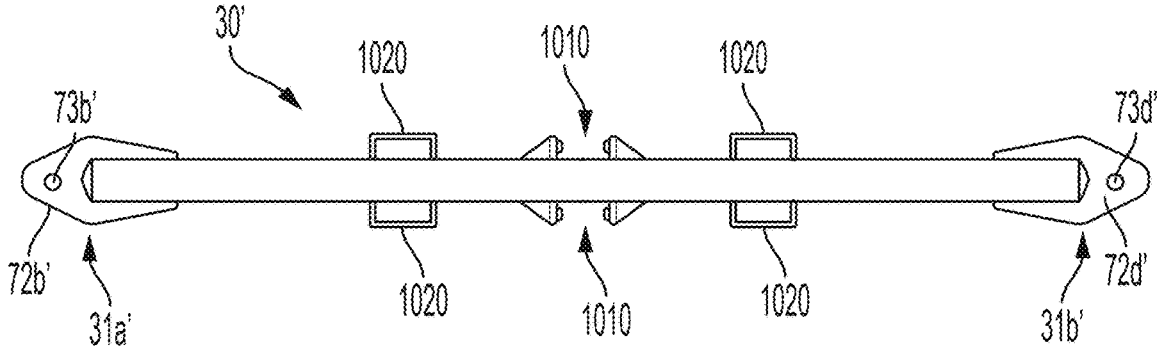
FIG. 13 is a bottom view of the elongate structural member of FIG. 10, in accordance with the present disclosure.

FIG. 9 depicts a top perspective view of a first elongate structural member 30 for use with and shown connected to an interconnection structure 10. The elongate structural member 30 includes an upper element 32 and a bottom element 33. Interspersed between elements 32, 33 are a plurality of diagonal support members 38. Each element 32, 33 is made of two L-shaped pieces of angle iron 39A, 39B. Elements 32, 33 typically may be identical in construction, with the exception being upper element 32 includes connector holes 54A, 54B at its midspan. The elongate structural member 30 includes a first end 31A and a second end 31B. At either end 31A, 31B of both the upper element 32 and bottom element 33 extends an upper connecting flange 35 and a lower connecting flange 36. Through both upper and lower connection flanges 35, 36 are connecting holes 37. Interior to each of the connector holes 37A, 37B, 37C, 37D are additional locking holes 360A, 360B, 360C, 360D also located on the connection flanges 35A, 35B, 35C, 35D. The elongate structural member 30 in FIG. 9 may commonly be called a bar joist, or open-web beam or joist. Such an elongate structural member is generally used as a horizontal member for an upper or lower framework of a modular space frame support system.

FIGS. 10-13 depict a second embodiment of an elongate structural member 30'. The elongate structural member 30' include a first end 31*a*' and a second end 31*b*'. The elongate structural member 30' includes a plurality of upper connection elements 1000 and lateral connection elements 1010. Each element 1000, 1010 is made of angled iron. Elements 1000, 1010 typically may be identical in construction, with the exception that lateral connection elements 1010 include connector holes 1012 at their respective midspans. Handles 1020 are optionally added to the sides of the elongate structural member 30'.

In the embodiment shown, the elongate structural member 30' is made of structural tubing. In an embodiment, the elongate structural member 30' is a single structural tubing shape; however, in other embodiments, the elongate structural member 30' could be made of multiple pieces of structural tubing shapes or other suitable shapes and materials.

Specifically, in the embodiment shown, the elongate structural member 30' is a squared tubular structure having two open ends 31*a*', 31*b*' configured to be secured directly or indirectly to an interconnection structure 10. In accordance with some embodiments, the elongate structural member 30' is configured to secure directly to an interconnection structure 10. However, in other embodiments, the ends 31*a*', 31*b*' of the elongate structural member 30' include one or more structures adapted to engage an interconnection structure 10, as described in further detail below.

In accordance with one embodiment, affixed to each of the open ends 31*a*', 31*b*' are two plates 72*a*', 72*b*', 72*c*', 72*d*'. At a given end, the plates are affixed to the outer surface of opposite sides of the squared tubular structure such that the respective plates 72*a*', 72*b*' and 72*c*', 72*d*' are parallel one another. Each of the plates 72*a*'-72*d*' extends outward from the respective end 31*a*', 31*b*' of the chord parallel with the elongate structural member 30'. Each plate 72*a*'-72*d*' further includes an opening 73*a*', 73*b*', 73*c*', 73*d*' positioned through the respective plate such that the openings 73*a*', 73*b*' and 73*c*', 73*d*' of respective pairs of plates 72*a*', 72*b*' and 72*c*', 72*d*' are corresponding and coaxial and form a linear passage through the respective plates. The respective pairs of openings 73*a*', 73*b*' and 73*c*', 73*d*' each receives a pin to secure in the interconnection structure 10.

In the embodiment shown, the plates 72*a*', 72*b*', 72*c*', 72*d*' are generally rhomboidal with the tip of the rhombus being rounded. It is understood that the particular shape and size of the plates 72*a*'-72*d*', however, can vary depending on the particular arrangement and components used in forming the modular space frame support system. For example, the plates 72*a*'-72*d*' can be true rectangles, round, arcuate, or any polygonal shape. Similarly, while in the embodiment shown the openings 73*a*'-73*d*' are shown centered near the rounded end of the plates 72*a*'-72*d*', in other embodiments, the openings 73*a*'-73*d*' may be offset or otherwise differently positioned.

In another embodiment, the openings may be formed within the elongate structural member 30' itself. In such an embodiment, the elongate structural member 30' has four openings—two aligned coaxial openings at either end of the elongate structural member 30' forming two passages through the entirety of the elongate structural member 30'. A corresponding interconnection structure would be designed with a projection containing a corresponding opening or openings which either inserts into the hollow center of the elongate structural member 30' or forms a cup into which the end of a chord is inserted.

It should be apparent to one skilled in the art that, while the elongate structural member 30' depicted in the figures is made of particular shaped elements, there are other embodiments that provide the aspects of the present invention, such as a bar joist, truss, shaped-steel (i.e., I-beam, C-beam, etc.), or the like. The elongate structural member 30' could also be made of shaped steel (e.g., wide flange elements, narrow flange members, etc.), or other suitable shapes and materials.

Such an elongate structural member 30' as shown is generally used as a horizontal member and, as will be described in further detail, generally in building an upper framework.

Figure 14:
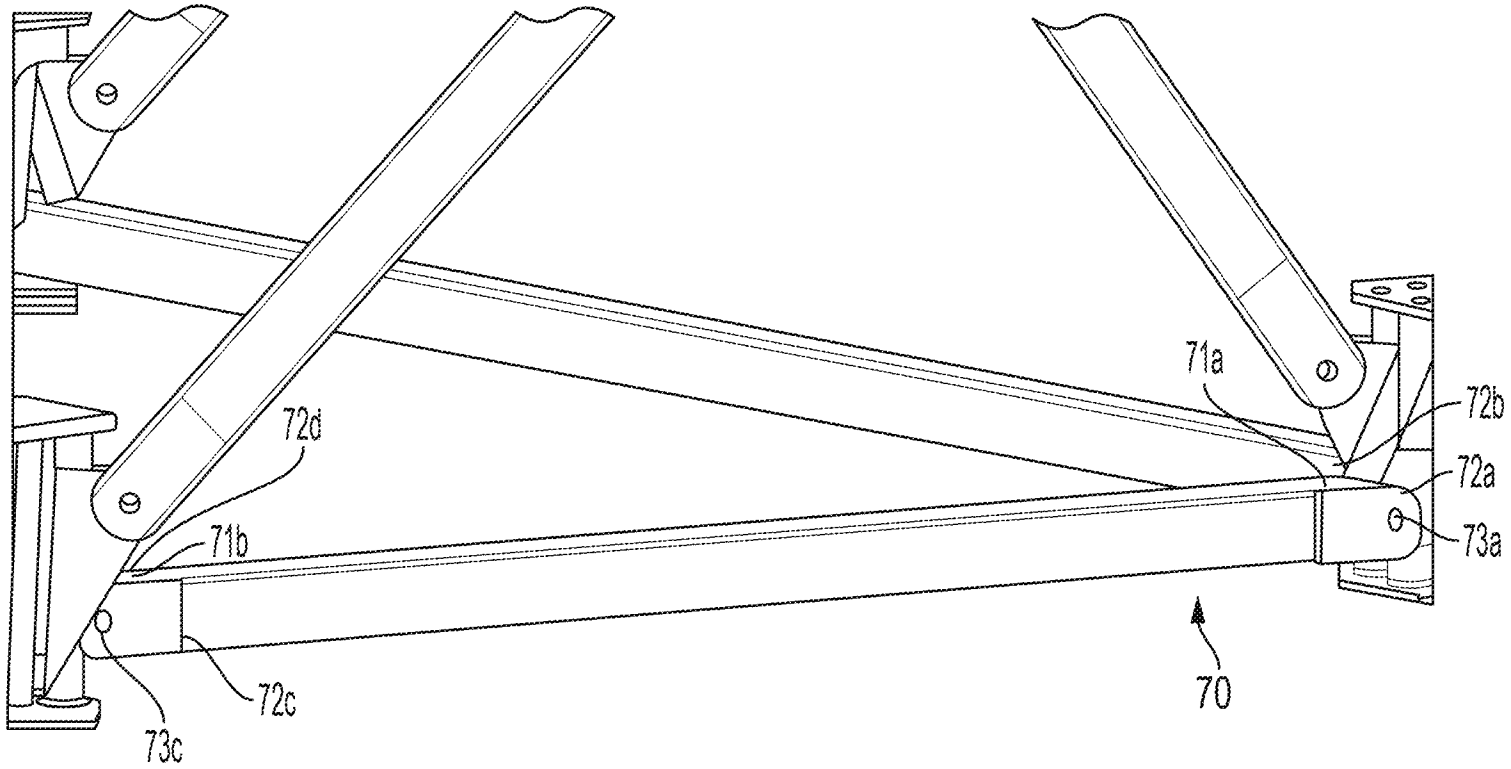
FIG. 14 shows another embodiment of an elongate structural member, in accordance with embodiments of the present disclosure.
Figure 15:
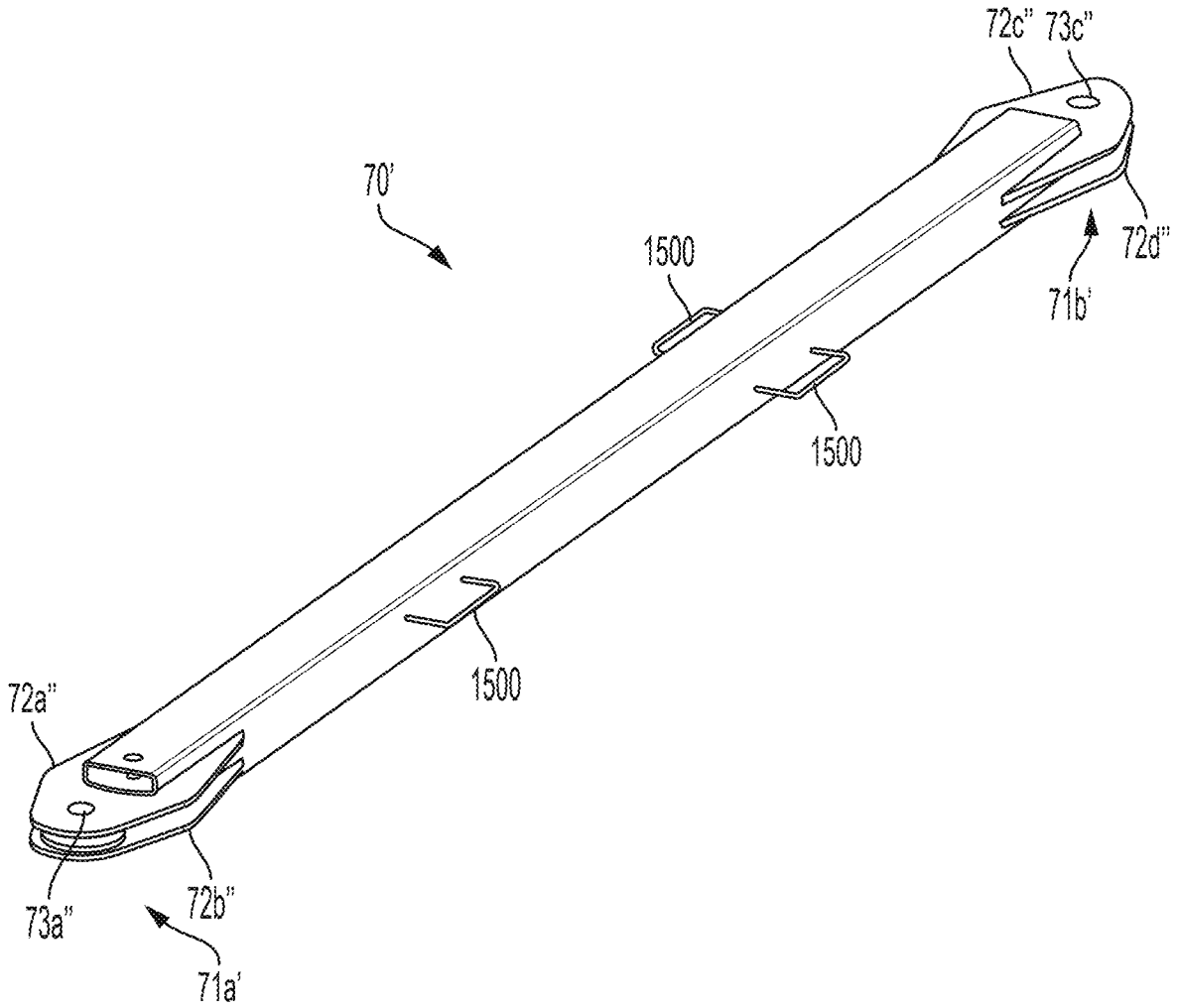
FIG. 15 is a top perspective view of a further embodiment of an elongate structural member, in accordance with the present disclosure.
Figure 16:
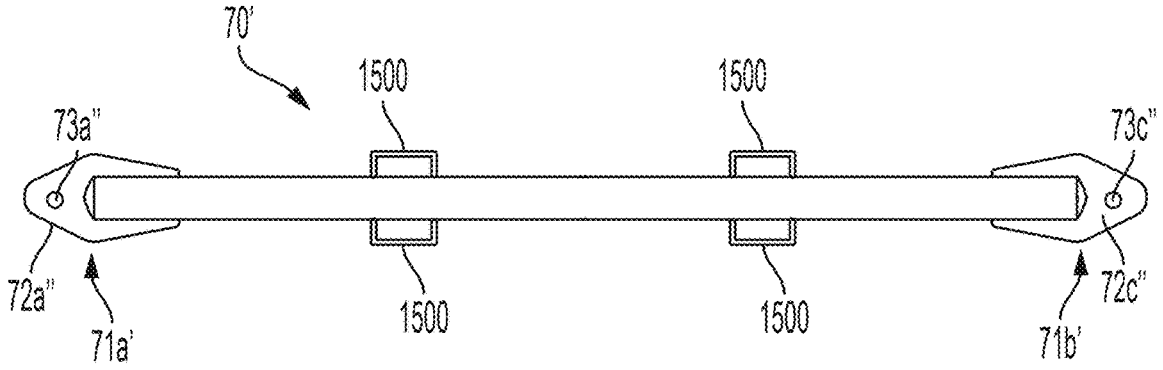
FIG. 16 is a top view of the elongate structural member of FIG. 15, in accordance with the present disclosure.
Figure 17:
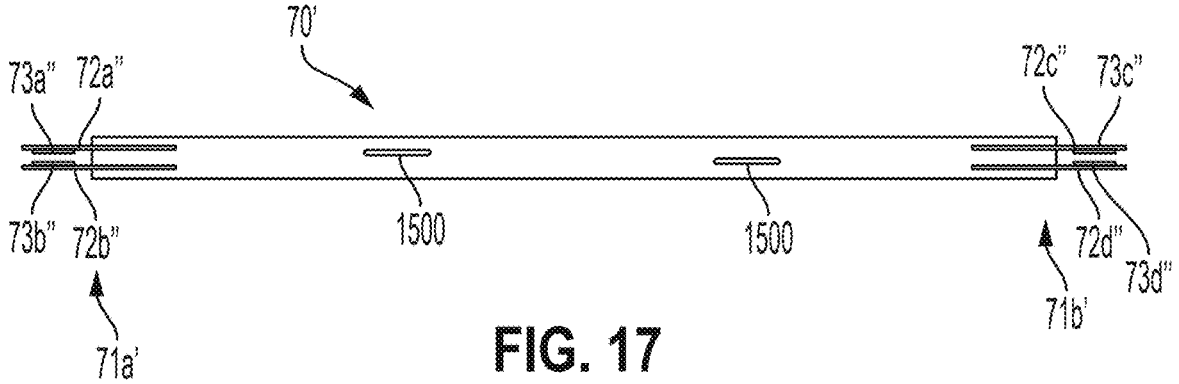
FIG. 17 is a side elevation view of the elongate structural member of FIG. 15, in accordance with the present disclosure.
Figure 18:
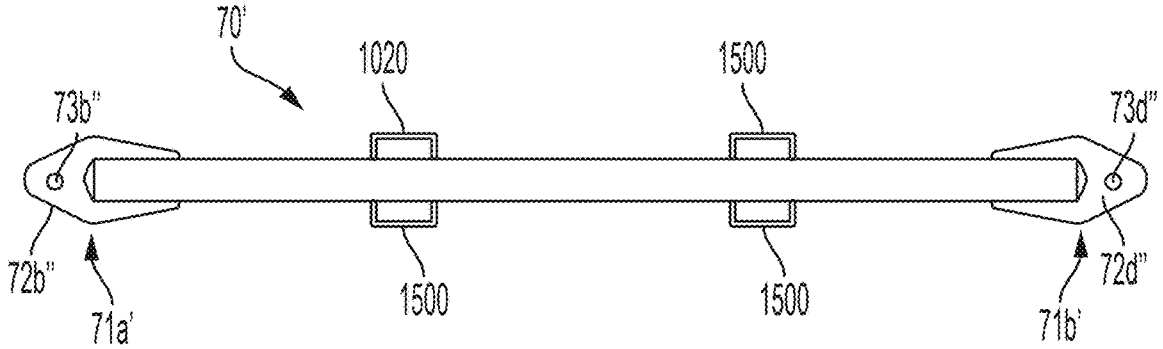
FIG. 18 is a bottom view of the elongate structural member of FIG. 15, in accordance with the present disclosure.
Figure 19:
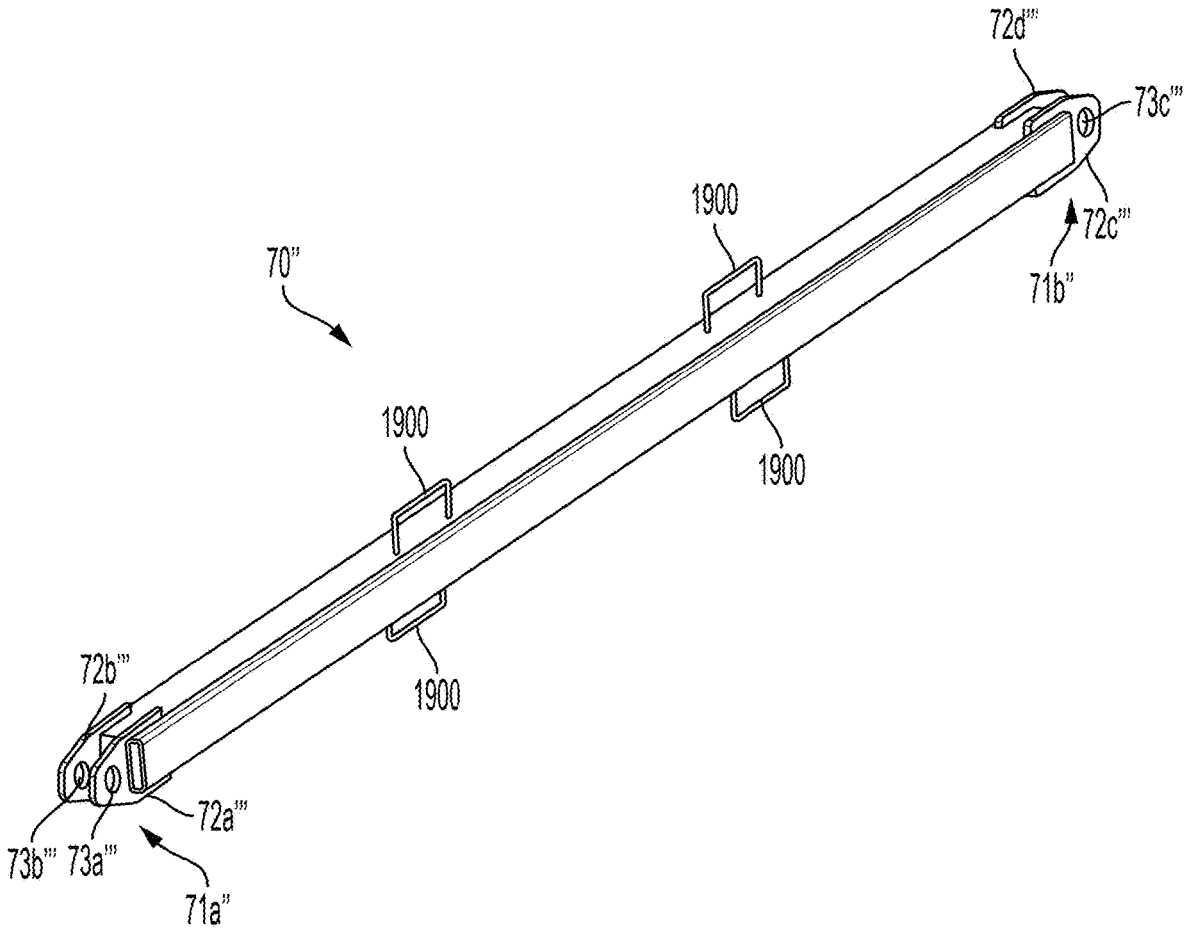
FIG. 19 is a top perspective view of yet a further embodiment of an elongate structural member, in accordance with the present disclosure.
Figure 20:
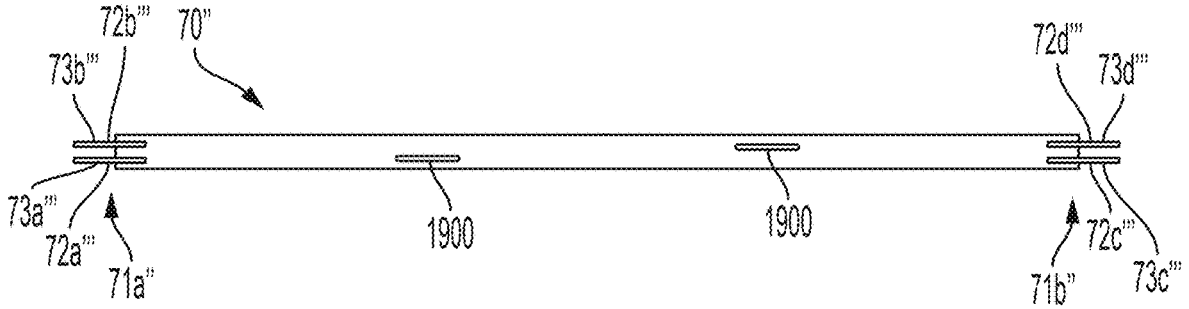
FIG. 20 is a top view of the elongate structural member of FIG. 19, in accordance with the present disclosure.
Figure 21:
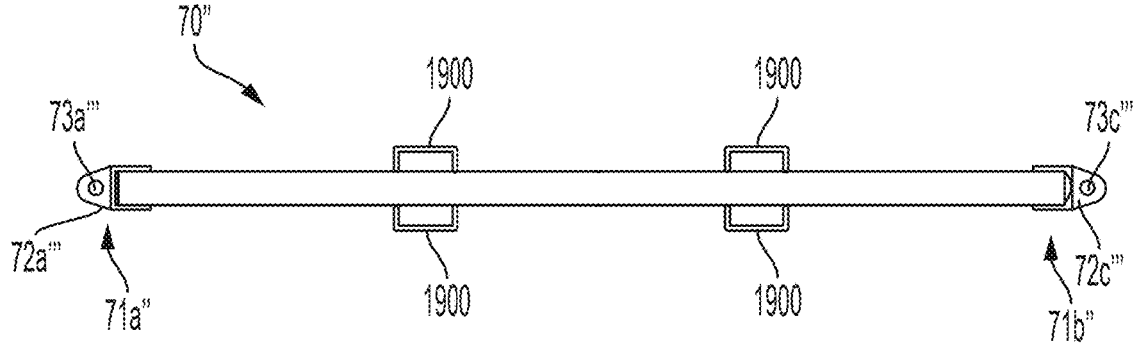
FIG. 21 is a side elevation view of the elongate structural member of FIG. 19, in accordance with the present disclosure.
Figure 22:
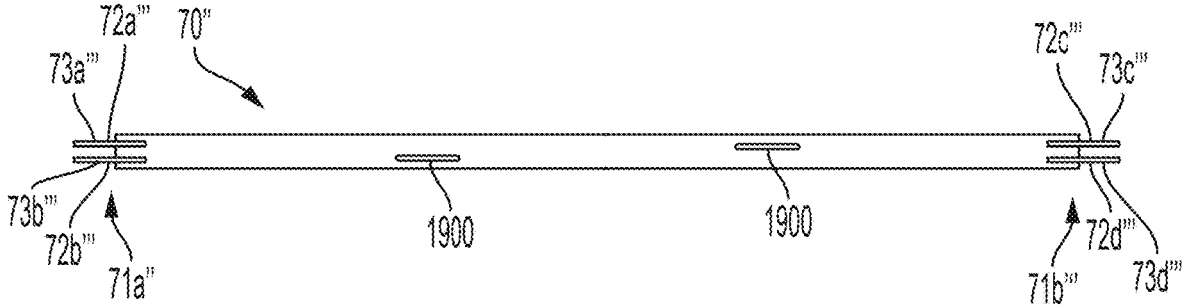
FIG. 22 is a bottom view of the elongate structural member of FIG. 19, in accordance with the present disclosure.

FIG. 14 depicts a perspective view of an embodiment of a further embodiment of an elongate structural member 70. The elongate structural member 70 is generally used as a horizontal member of a lower framework for a modular space frame support system or a diagonal member. Such an elongate structural member is therefore referred to generally as a chord 70. When used in reference to elongate structural member 70, the terms "elongate structural member" and "chord" may be used interchangeably. In the embodiment shown, the chord 70 is an elongate tubular member adapted for bearing or supporting a load.

In the embodiment shown, the chord 70 is made of structural tubing. Specifically, in the embodiment shown, the chord 70 is a squared tubular structure having two open ends 71*a*, 71*b* configured to be secured directly or indirectly to an interconnection structure 10.

In accordance with one embodiment, affixed to each of the open ends 71*a*, 71*b* are two plates 72*a*, 72*b*, 72*c*, 72*d*. At a given end, the plates are affixed to the outer surface of opposite sides of the squared tubular structure such that the respective plates 72*a*, 72*b* and 72*c*, 72*d* are parallel one another. Each of the plates 72*a*-72*d* extends outward from the respective end 71*a*, 71*b* of the chord parallel with the chord 70. Each plate 72*a*-72*d* further includes an opening 73*a*, 73*b* (not shown), 73*c*, 73*d* (not shown) positioned through the respective plate such that the openings 73*a*, 73*b* (not shown) and 73*c*, 73*d* (not shown) of respective pairs of plates 72*a*, 72*b* and 72*c*, 72*d* are corresponding and coaxial and form a linear passage through the respective plates. The respective pairs of openings 73*a*, 73*b* (not shown) and 73*c*, 73*d* (not shown) each receives a pin to secure in the interconnection structure 10.

FIGS. 15-18 depict a further embodiment of an elongate structural member 70. Such an elongate structural member is generally used as a horizontal member of a lower framework for a modular space frame support system. As such, in some embodiments, the elongate structural member is referred to as a bottom chord 70'.

The bottom chord 70' is an elongate tubular member adapted for bearing or supporting a load. In the embodiment shown, the bottom chord 70' is made of structural tubing. The bottom chord 70' includes a first end 71*a*' and a second end 71*b*'. Handles 1500 are optionally added to the sides of the bottom chord 70'.

In an embodiment, the bottom chord 70' is a single structural tubing shape; however, in other embodiments, the bottom chord 70' could be made of multiple pieces of structural tubing shapes or other suitable shapes and materials.

Specifically, in the embodiment shown, the bottom chord 70' is a squared tubular structure having two open ends 71*a*', 71*b*' configured to be secured directly or indirectly to an interconnection structure 10. In accordance with some embodiments, the bottom chord 70' is configured to secure directly to an interconnection structure 10. However, in other embodiments, the ends 71*a*', 71*b*' of the bottom chord 70' include one or more structures adapted to engage an interconnection structure 10, as described in further detail below.

In accordance with one embodiment, affixed to each of the open ends 71*a*', 71*b*' are two plates 72*a*", 72*b*", 72*c*", 72*d*". At a given end, the plates are affixed to the outer surface of opposite sides of the squared tubular structure such that the respective plates 72*a*", 72*b*" and 72*c*", 72*d*" are parallel one another. Each of the plates 72*a*"-72*d*" extends outward from the respective end 71*a*', 71*b*' of the chord parallel with the bottom chord 70'. Each plate 72*a*"-72*d*" further includes an opening 73*a*", 73*b*" (not shown), 73*c*", 73*d*" (not shown) positioned through the respective plate such that the openings 73*a*", 73*b*" (not shown) and 73*c*", 73*d*" (not shown) of respective pairs of plates 72*a*", 72*b*" and 72*c*", 72*d*" are corresponding and coaxial and form a linear passage through the respective plates. The respective pairs of openings 73*a*", 73*b*" (not shown) and 73*c*", 73*d*" (not shown) each receives a pin to secure in the interconnection structure 10.

In the embodiment shown, the plates 72*a*", 72*b*", 72*c*", 72*d*" are generally rhomboidal with the tip of the rhombus being rounded. It is understood that the particular shape and size of the plates 72*a*"-72*d*", however, can vary depending on the particular arrangement and components used in forming the modular space frame support system. For example, the plates 72*a*"-72*d*" can be true rectangles, round, arcuate, or any polygonal shape. Similarly, while in the embodiment shown the openings 73*a*"-73*d*" are shown centered near the rounded end of the plates 72*a*"-72*d*", in other embodiments, the openings 73*a*"-73*d*" may be offset or otherwise differently positioned.

In another embodiment, the openings may be formed within the bottom chord 70' itself. In such an embodiment, the bottom chord 70' has four openings—two aligned coaxial openings at either end of the bottom chord 70' forming two passages through the entirety of the bottom chord 70'. A corresponding interconnection structure would be designed with a projection containing a corresponding opening or openings which either inserts into the hollow center of the bottom chord 70' or forms a cup into which the end of a chord is inserted.

Bottom chords 70' can be used in the modular space frame support system 100 in a lower frame 120 of a modular space frame support system 100. In such an embodiment, it will be appreciated that work platforms 50 are not secured to the lower frame 120 and a resulting work platform system 200 constructed using the modular space frame support system 100 will be a single-level work platform system.

FIGS. 19-22 depict a further elongate structural member 70 which, in the embodiment shown, is generally used as a diagonal member of a modular space frame support system, and is therefore referred to as a diagonal chord 70". The diagonal chord 70" is an elongate tubular member adapted for bearing or supporting a load. Diagonal chords 70" can be used in the modular space frame support system 100 as diagonal supports. The diagonal chord 70" includes a first end 71*a*" and a second end 71*b*". Handles 1900 are optionally added to the sides of the diagonal chord 70".

In the embodiment shown, the diagonal chord 70" is made of structural tubing. In an embodiment, the diagonal chord 70" is a single structural tubing shape; however, in other embodiments, the diagonal chord 70" could be made of multiple pieces of structural tubing shapes or other suitable shapes and materials.

Specifically, in the embodiment shown, the diagonal chord 70" is a squared tubular structure having two open ends 71*a*", 71*b*" configured to be secured directly or indirectly to an interconnection structure 10. In accordance with some embodiments, the diagonal chord 70" is configured to secure directly to an interconnection structure 10. However, in other embodiments, the ends 71*a*", 71*b*" of the diagonal chord 70" include one or more structures adapted to engage an interconnection structure 10, as described in further detail below.

In accordance with one embodiment, affixed to each of the open ends 71*a*", 71*b*" are two plates 72*a*'", 72*b*'", 72*c*'", 72*d*'". At a given end, the plates are affixed to the outer surface of opposite sides of the squared tubular structure such that the respective plates 72*a*'", 72*b*'" and 72*c*'", 72*d*'" are parallel one another. Each of the plates 72*a*'"-72*d*'" extends outward from the respective end 71*a*", 71*b*" of the chord parallel with the diagonal chord 70". Each plate 72*a*'"-72*d*'" further includes an opening 73*a*'", 73*b*'", 73*c*'", 73*d*'" positioned through the respective plate such that the openings 73*a*'", 73*b*'" and 73*c*'", 73*d*'" of respective pairs of plates 72*a*'", 72*b*'" and 72*c*'", 72*d*'" are corresponding and coaxial and form a linear passage through the respective plates. The respective pairs of openings 73*a*'", 73*b*'" and 73*c*'", 73*d*'" each receives a pin to secure in the interconnection structure 10'.

In the embodiment shown, the plates 72*a*'", 72*b*'", 72*c*'", 72*d*'" are generally triangular with the tip of the triangle being rounded. It is understood that the particular shape and size of the plates 72*a*'"-72*d*'"; however, can vary depending on the particular arrangement and components used in forming the modular space frame support system. For example, the plates 72*a*'"-72*d*'" can be true rectangles, round, arcuate, or any polygonal shape. Similarly, while in the embodiment shown the openings 73*a*'"-73*d*'" are shown centered near the rounded end of the plates 72*a*'"-72*d*'", in other embodiments, the openings 73*a*'"-73*d*'" may be offset or otherwise differently positioned.

In another embodiment, the openings may be formed within the diagonal chord 70" itself. In such an embodiment, the diagonal chord 70" has four openings—two aligned coaxial openings at either end of the diagonal chord 70" forming two passages through the entirety of the diagonal chord 70". A corresponding interconnection structure would be designed with a projection containing a corresponding opening or openings which either inserts into the hollow center of the diagonal chord 70" or forms a cup into which the end of a chord is inserted.

Modular Space Frame Support System

Figure 23:
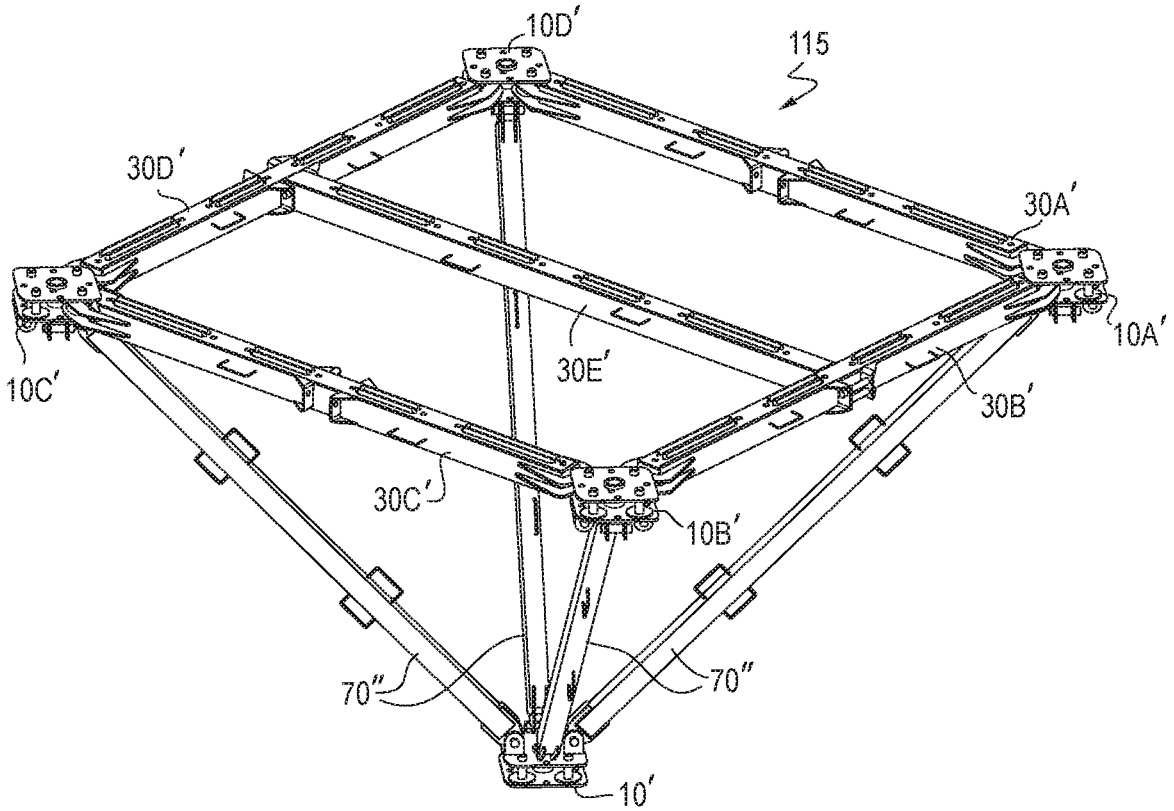
FIG. 23 is a top perspective view of a single unit of a modular space frame support system, in accordance with embodiments of the present disclosure.

FIG. 23 depicts a single section or unit 115 of a modular space frame support system 100 made using interconnection structures 10' and elongate structural members 30' to form an upper framework, and diagonal elongate structural members 70" and a single interconnection structure 10' forming a lower framework. Note that four interconnection structures 10A', 10B', 10C', 10D' are interconnected with four elongate structural members 30A', 30B', 30C', 30D'. FIG. 23 shows the single frame unit 115 that is square in plan. It should be apparent to one skilled in the art, that other shapes and configurations can be made. By varying the lengths of elongate structural members 30', for example, other shapes can be made. For example, a frame unit 115 that is rectangular can be constructed. Also, by attaching elongate structural members 30' to various openings 13', 14' of the interconnection structure 10', various angles at which the elongate structural members 30' interconnect with the interconnection structure 10' can be achieved. For example, a frame unit 115 that is triangular in plan (not shown) may be constructed. Thus, by changing elongate structural member 30' lengths and/or changing the angle(s) at which the elongate structural members 30' extend from the interconnection structure 10', virtually any shape and size frame unit 115, and resulting modular space frame support system 100 and work platform systems 200 may be constructed. Further, different shape, size, and configuration of frame sections or units 115 can be joined and abutted with each other, so that the modular space frame support system design, and work platform system design, is virtually completely customizable. This adaptability of the modular space frame support system 100 provides a convenient way to gain access to virtually any shape work area required in construction.

Figure 24:
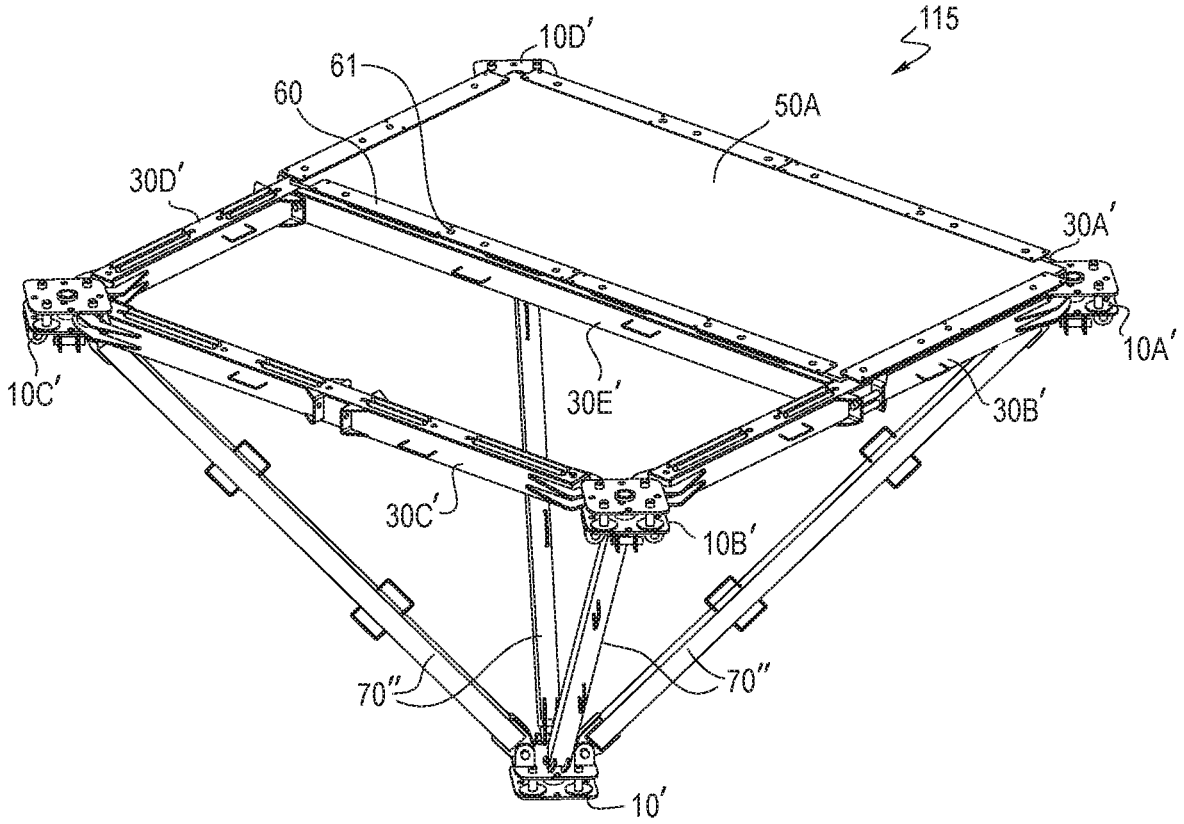
FIG. 24 shows the unit of FIG. 23 with a deck platform, in accordance with embodiments of the present disclosure.
Figure 25:
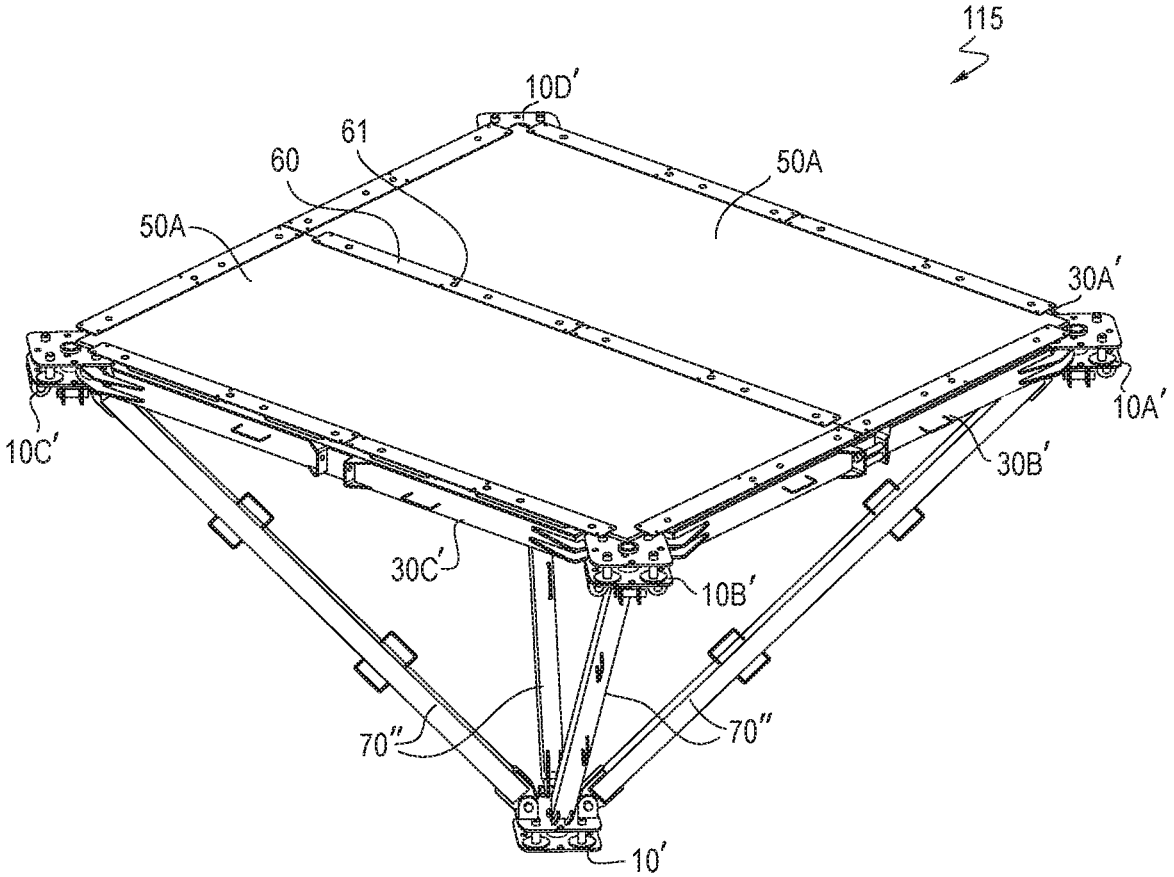
FIG. 25 shows the unit of FIG. 24 with a second deck platform, in accordance with embodiments of the present disclosure.

FIG. 24 shows the single frame section or unit 115 from FIG. 23 wherein a platform 50A has been placed on the single frame unit 115 thus starting to transform the single frame unit 115 into a single unit of a work platform system 200. In the embodiment shown, the platform 50A is approximately the size of half of the upper frame section and is therefore supported along a long edge by elongate structural member 30A' and the short edges by elongate structural members 30B' and 30D'. The remaining long edge is supported by modified elongate structural member 30E' which is positioned in the middle of each frame unit 115. When arranged in the middle of a frame unit 115, an elongate structural member 30' can provide added support to support platforms 50 and may span between and be normal to a pair of elongate structural member 30'. At either end of such elongate structural member 30' can be a pin 53 that communicates with a corresponding connector hole 1012 at the respective midspans of lateral connection elements 1010. The configuration of upper connection elements 1000 of the middle elongate structural member 30' and the other elongate structural members 30' is such that vertical and horizontal movement of the platform 50A is avoided. A deck retainer plate 60 may be placed over the spacing between the multiple work platforms 50, such as shown in FIG. 25. The deck retainer plate 60 may include a plurality of holes 62 so that a plurality of deck retainer bolts 61 may adhere the deck retainer plate 60 to the elongate structural member 30'. The deck retainer plate 60 is one way in which to secure work platforms 50 to the modular space frame support system 100.

The work platform 50 typically is sized to be a 4"×8' piece of material. Suitable work platform 50 may be made from metal (e.g., steel, aluminum, etc.), wood, plastic, composite, or other suitable materials. Similarly, the work platform 50 may be made of items that are solid, corrugated, grated, smooth, or other suitable configurations. For example, the work platform 50 may be wood sheeting, plywood, roof decking material, metal on a frame, grating, steel sheeting, and the like. Thus, after placing a first work platform 50A on the unit 115 of the modular space frame support system 100, an installer may continue in this manner and place additional multiple work platforms 50A, 50B, such as shown in FIG. 25, so that an entire upper frame 110 and/or lower frame 120 is covered with work platforms 50A, 50B so that a complete work platform system 200 is created.

Figure 26:
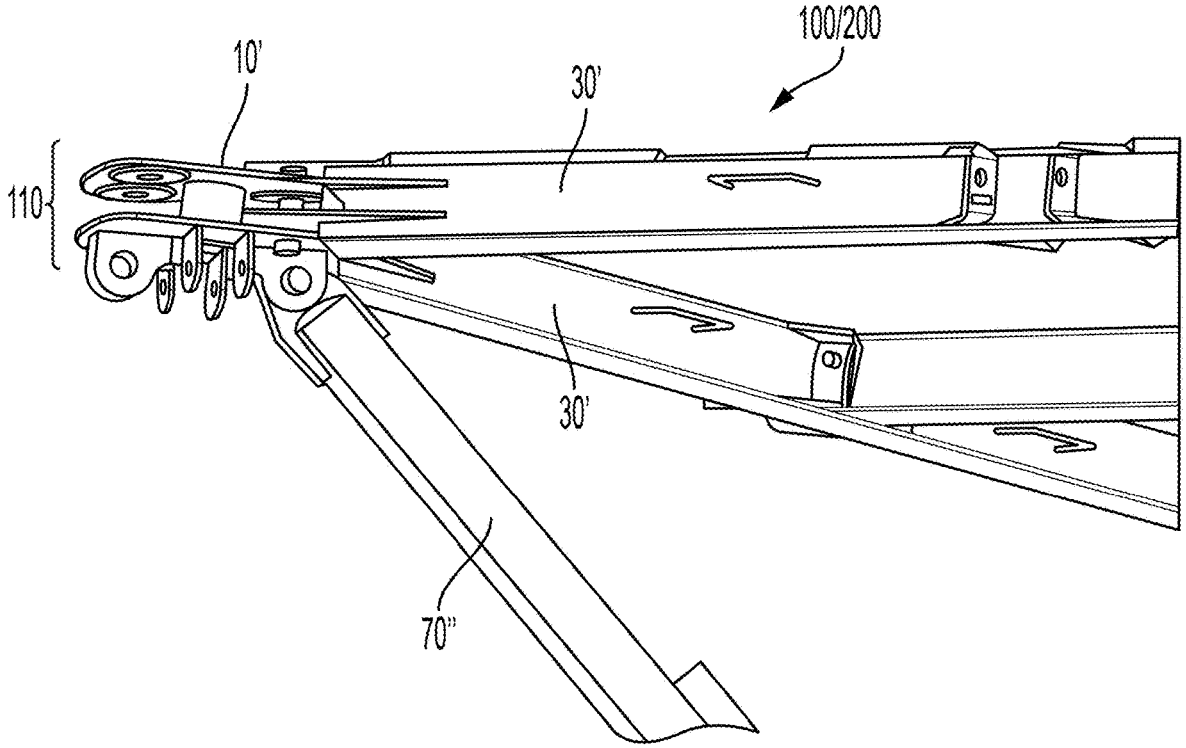
FIG. 26 shows the connections of elongate structural members with an upper interconnection structure, in accordance with embodiments of the present disclosure.

FIG. 26 depicts a side perspective view of the interconnection between a plurality of elongate structural members and an interconnection structure 10'. In particular, FIG. 26 shows an interconnection structure 10' from an upper frame 110 with two elongate structural members 30' and three diagonal chords 70". The interconnection structure 10' is in use on an upper frame 110, meaning that the diagonal chords 70" project away from the interconnection structure 10' at a downward angle.

Figure 27:
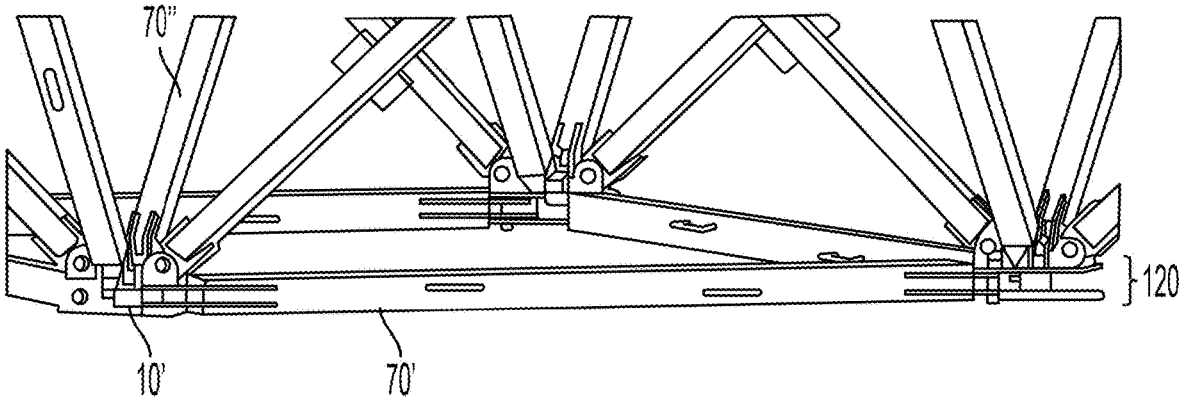
FIG. 27 shows the connections of elongate structural members with a lower interconnection structure, in accordance with embodiments of the present disclosure.

FIG. 27 depicts a side perspective view of the interconnection between a plurality of bottom chords 70', a plurality of diagonal chords 70", and interconnection structures 10'. In particular, FIG. 27 shows interconnection structures 10' from a lower frame 120, each interconnection structure 10' engaging two bottom chords 70' and four diagonal chords 70". In the embodiment shown in FIG. 27, the interconnection structures 10' are in use on a lower frame 120, meaning that the diagonal chords 70" project away from the interconnection structures 10' at an upward angle.

As described above, the ends 31', 71', 71" of the elongate structural members 30', the bottom chords 70', and the diagonal chords 70" are each configured to engage an interconnection structure 30'. When an elongate structural member 30', a bottom chord 70', or a diagonal chord 70" is aligned with respect to the interconnection structure 10', the openings 73', 73", 73'" in the end plates 72', 72", 72'" of the elongate structural member 30', bottom chord 70', or diagonal chord 70" and openings 76*a*', 76*b*' in the plates 79*a*', 79*b*' of the interconnection structure 10' align to form a single continuous passage. The elongate structural member 30', bottom chord 70', or diagonal chord 70" is then secured to the interconnection structure 10' using a securing structure such as a pin, nut and bolt configuration, wire and pin, etc.

In the particular embodiment shown, the distance between plates 79*a*', 79*b*" of the interconnection structure 10' is more than the distance between the plates 72', 72", 72'" of the end 31*a*', 71*a*', 71*a*" of the elongate structural member 30', the bottom chord 70', or the diagonal chord 70". In this way, the plates 79*a*', 79*b*' of the interconnection structure 10' are on the outside of the end 31*a*', 71*a*', 71*a*" of the elongate structural member 30', the bottom chord 70', or the diagonal chord 70". However, in an alternative embodiment, the distance between the plates 79*a*', 79*b*' of the interconnection structure 10' may be less than the distance between the plates 72', 72", 72'" of the end 31*a*', 71*a*', 71*a*" of the elongate structural member 30', the bottom chord 70', or the diagonal chord 70" such that the end 31*a*', 71*a*', 71*a*" of the elongate structural member 30', the bottom chord 70', or the diagonal chord 70" is slid over the plates 79*a*', 79*b*' of the interconnection structure 10'.

Figure 28:
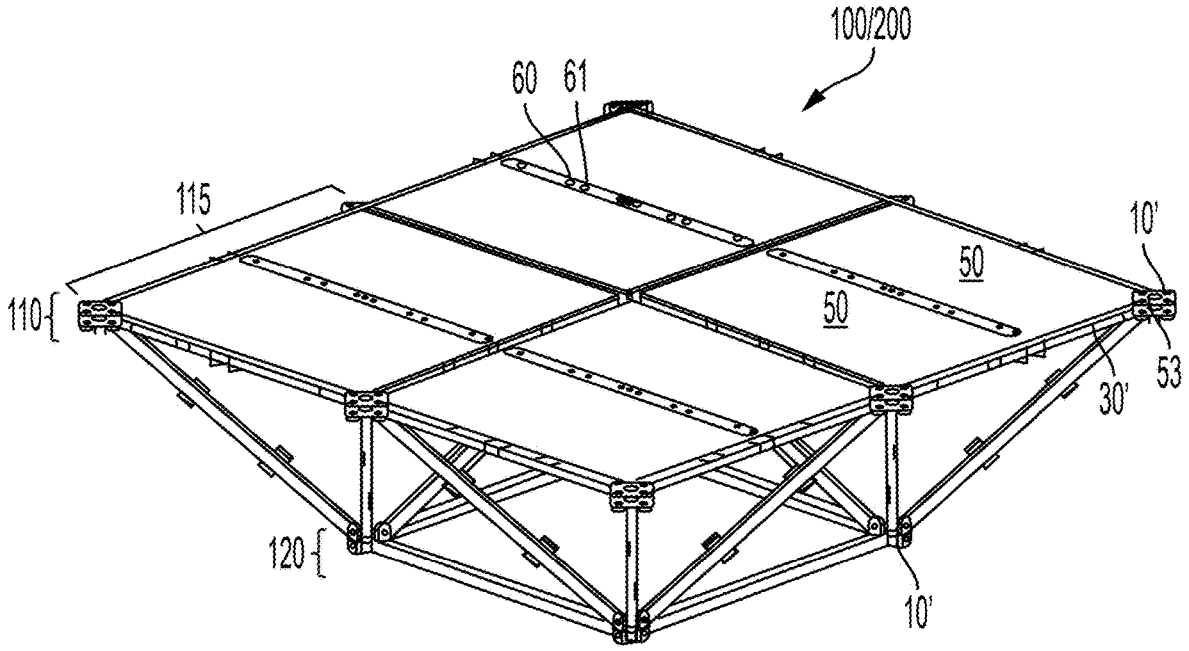
FIG. 28 is a top perspective view of a further work platform system, in accordance with embodiments of the present disclosure.
Figure 29:
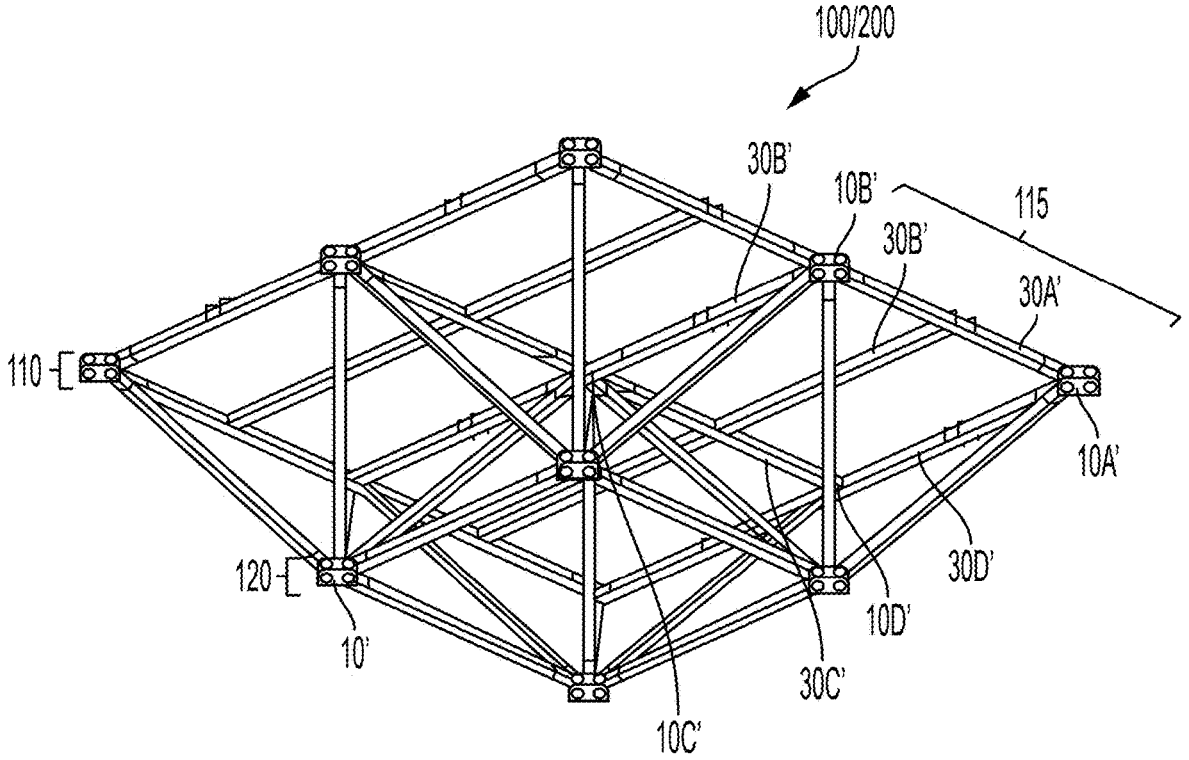
FIG. 29 is a bottom perspective view of the work platform system of FIG. 28, in accordance with the present disclosure.

FIGS. 28 and 29 depict a further embodiment of a plurality of sections or units 115 of a modular space frame support system 100 made using interconnection structures 10' and elongate structural members 30', wherein work platforms 50 have been placed on the frame units 115 thus transforming the frame units 115 into a single unit of a work platform system 200.

In particular, in accordance with an embodiment of the present disclosure, and as shown in FIGS. 28 and 29, a work platform system 200 is shown with an upper frame 110 having four individual sections or units 115 arranged in a 2×2 configuration. The lower frame 120 is composed of one individual unit with given interconnection structures 10' of the lower frame 120 positioned directly below the centers of the work platforms 50 of the upper frame 110. In other words, the lower frame 120 is smaller than the upper frame 110 such that the upper frame 110 overhangs the lower frame 120 on all sides. Notwithstanding the particular shape and arrangement of the modular space frame support system 100 and resultant work platform system 200 shown in FIGS. 28 and 29, it is understood that the modular space frame support system 100 and resultant work platform system 200 can take a number of shapes, sizes, and configurations with the interconnection structures 10' of the lower frame 120 still positioned directly below the center of a work platform 50 of the upper frame 110.

While in the embodiment shown in FIGS. 28 and 29, the interconnection structures 10' of the lower frame 120 are offset relative to the interconnection structures 10' of the upper frame, 110, in further embodiments, the interconnection structures 10' of the lower frame 120 may be positioned immediately below the interconnection structures 10' of the upper frame 110. In such an embodiment, each interconnection structure 10' of the lower frame 120 is interconnected with bottom chords 70' and diagonal chords 70", and may be further connected to its corresponding interconnection structure 10' of the upper frame 110 using a vertical support member. A vertical support member is an elongate structural member having a first end configured to engage the bottom element 12/12' of an interconnection structure 10/10' and a second end configured to engage the top element 11/11' of an interconnection structure 10/10'. In some embodiments, the second end may be specifically configured to engage the center opening 16 of the top element 11/11'.

Notwithstanding the particular shape and arrangement of the modular space frame support system 100 and resultant work platform system 200, it is understood that the modular space frame support system 100 and resultant work platform system 200 can take a number of shapes, sizes, and configurations with the interconnection structures 10' of the lower frame 120 still positioned directly below the interconnection structures 10' of one of the units 115 of the upper frame 110.

In further embodiments, the distance between the upper and lower framework 110, 120 is increased relative to the distance therebetween in another embodiment. By increasing the distance between the upper frame 110 and lower frame 120, and thereby increasing the length of diagonal chords 70", the load capacity is increased. For example, while in the embodiment shown, each of the diagonal chords 70" used in the modular space frame support system 100 have the same length, in further embodiments, a portion of a modular space frame support system 100 may utilize diagonal chords have a length greater than those of another portion (or the remainder) of the modular space frame support system 100. The ability to modularly increase the load capacity of portions of a modular space frame support system allows for smaller and lighter components to be used for a majority of the modular space frame support system, and the larger, heavier components to be used only where needed.

Additional Components

In some embodiments, a railing can be connected to an upper frame 110. A railing standard is typically elongate and includes a first flange, and a second flange extending therefrom for connection to an interconnection structure 10/10'. The first flange has a hole in it, as does the second flange. By leading the pin through the upper flange, then through holes 13/13' in the top element 11/11' down through the lower flange, and then through the holes 14/14' in the bottom element 12/12' an installer is able to attach the railing standard to the interconnection structure 10/10' of the modular space frame support system 100. The pin can include various devices, such as roll pins and a holding loop. In this manner, a plurality of railing standards may be attached to a plurality of interconnection structures, creating a railing system around a work platform system 200.

The railing can be a variety of materials, such as chain, cable, line, and the like. For example, the railing may be galvanized aircraft cable. The railing standard includes a plurality of holes. A J-bolt may be used with a nut to attach the railing to the railing standard. In an embodiment, an additional railing may be added at the midpoint of the railing standard. In other embodiments, the railing standards can also be used to erect a work enclosure system. For example, tarps, sheeting, or the like could be attached to the railing standards to enclose the work area for painting, demolition, asbestos or lead paint abatement, and similar activities where the workers do not want any escape of fumes, paint, hazardous materials, debris, etc. from the work area.

In one particular embodiment, a modular space frame support system 100 comprises an upper frame and a lower frame. The upper frame comprises at least a first interconnection structure connected in fixed relation to a second interconnection structure using a first elongate structural member; a second elongate structural member connectable to the first interconnection structure; a third elongate structural member connectable to the second interconnection structure; a third interconnection structure connected in fixed relation to the second elongate structural member; a fourth interconnection structure connected in fixed relation to the third elongate structural member; and a fourth elongate structural member connecting the third interconnection structure and the fourth interconnection structure. In an embodiment, at least one of the first, second, third and fourth elongate structural members is connectable with at least one of the respective interconnection structures using a pin.

The upper frame and lower frame are connected to one another by at least one of a diagonal chord and a vertical support. In an embodiment, the upper frame is connected to the lower frame by a plurality of diagonal chords, each of which is secured at one end to an interconnection structure of the upper frame and at a second end to an interconnection structure of the lower frame. In an embodiment, the upper frame and lower frame are connected to one another using both at least one diagonal chord and at least one vertical support.

In an embodiment, the modular space frame support system has a section of greater than 1 foot, or greater than 3 feet, or greater than or equal to 5 feet. In an embodiment, the modular space frame support system has a section of from greater than 1 foot, or greater than 3 feet, or greater than or equal to 5 feet, or 6 feet, or 7 feet, or 8 feet, or 9 feet, or 10 feet.

In an embodiment, the modular space frame support system has a span capacity of greater than 20 feet, or greater than 50 feet, or greater than 60 feet, or greater than 70 feet, or greater than 80 feet to 100 feet.

In an embodiment, the modular space frame support system has a dead load capacity of greater than 2 pounds per square foot, or greater than 3 pounds per square foot, or greater than 5 pounds per square foot to 7 pounds per square foot.

Method of Erecting a Modular Space Frame Support System

In general, when erecting a modular space frame support system as disclosed herein, a first frame comprising a plurality of interconnection structures and elongate structural members is assembled. A second frame is then assembled either above or below the first frame, depending on the construction of the second frame, and connected with the first frame by way of one or more diagonal chords and/or vertical supports. In a particular embodiment, the first frame assembled is the lower frame and the second frame assembled is the upper frame.

In some embodiments, and particularly those in which the modular space frame support system will be used as a work platform system, work platforms may be installed on the first and/or second frames, depending on the particular construction of the first and second frames. As described above, work platforms are generally installed only on upper frames.

The first and second frames are then secured to one another. To secure the first and second frames with respect to one another, at least one diagonal chord, vertical support or combination thereof is secured at a first end to the first frame and at a second end to the second frame.

Again, it will be appreciated that the particular structure of the first and second frames can influence the steps in assembling/erecting a modular space frame support system. In the particular embodiment, a first frame is assembled, a second frame is assembled and the diagonal chords are attached between the first and second frames. In an embodiment, the step of attaching diagonal chords between the first and second frames is according to any of the exemplary methods described above with relation to chord 70/70'.

The method in which vertical supports are used, differs in that a first end of the vertical supports is connected to the interconnection structures of the first frame after assembly of the first frame and a second end of the vertical supports is connected to the interconnection structures of the second frame after assembly of the second frame. The steps of installing work platforms on the first frame and attaching diagonal chords to the first and second frames are optional steps.

Again, it will be understood that the chords used as diagonal chords to secure a first frame and a second frame may be in accordance with any embodiment or combination of embodiments described herein.

In an embodiment, if needed, one or more suspension connectors, such as high strength chains, can be used to secure the lower frame 120 to a structure, such as an overhead structure like a bridge, prior to the upper frame 110 being assembled. In this manner, a modular space frame support system can be fully suspended from a suitable structure. Note that each interconnection structure does not necessarily require a suspension connector to be connected to the structure. One or more suspension connectors can be used to secure the upper frame 110, once assembled, to the structure. Once the upper frame 110 is built and secured to a structure using one or more suspension connectors, if desired, the suspension connectors from the lower frame 120 can be removed.

The suspension connector may be any suitable support mechanism that can support the modular space frame support system 100, resulting work platform system 200, and all its ancillary dead loads, plus any intended live load that is placed upon the work platform system 200. The suspension connector may be a high-strength chain, cable, or the like. For example, one suitable suspension connector is ⅜", grade 100, heat-treated alloy chain. The suspension connector is attached to a beam clamp which is further attached to a plurality of elements on the underside of a structure. The structure may be a bridge, viaduct, ceiling structure of a building, or the like. Similarly, the elements which the suspension connector are attached to may be beams, joists, or any other suitable structural element of the structure. Instead of beam clamps, other suitable structure attachment devices may be used.

A free end of the suspension connector is placed through the center opening area 19/19' of the top element 11/11' of the interconnection structure 10/10'. The suspension connector is then slid over and in to one of the four slots 17/17' (e.g., 17A/17A'). Once the suspension connector is placed within slot 17A/17A', a chain retainer pin is placed in the adjacent transverse slot 18A/18A' so that the suspension connector is kept retained in the distal end of slot 17A/17A'. The suspension connector and slot 17A/17A' are sized and configured so that upon proper placement of the keeper pin within the transverse slot 18A/18A', the suspension connector is effectively locked to the interconnection structure 10/10' and is unable to slip, vertically or horizontally, from its position in 17A/17A'. This locking system effectively fixes the interconnection structure 10 to the suspension connector.

An alternative device for connecting a suspension connector to an upper frame 110 or lower frame 120 of a modular space frame support system 100 is an auxiliary suspender mounting bracket. The auxiliary mounting bracket is typically used when a particular interconnection structure 10/10' cannot be accessed for connection with a suspension connector. One embodiment of the auxiliary suspender mounting bracket includes two opposing and parallel flanges. Spanning the flanges is an interconnecting tube and a base plate. Through the base plate are a plurality of mounting holes. The auxiliary suspender mounting bracket can be used in lieu of, or in addition to, the interconnection structure 10/10' for a suspension point. The bracket allows a suspension connector to be connected to the modular space frame support system 100 at locations other than an interconnection structure 10/10'.

One or more obstructions may be located on the underside of the structure, or between the structure and the modular space frame support system 100. These obstruction(s) may be man-made, or natural. For example, the obstructions may be concrete beams, box-beams, inadequately sized framework, ductwork, lighting, finished surfaces, and the like. The obstructions are such that a particular interconnection structure 10/10' is not practical, or possible, as a connecting point for the modular space frame support system 100 to a suspension connector. In this case, one or more auxiliary suspender mounting brackets may be attached to an elongate structural member. High strength bolts may be passed through the mounting holes and then through holes on an upper element and connected to bolts below the upper element. The suspension connector (e.g., chain) may be connected, via a beam clamp, to a beam that is on the underside of the structure.

An obstruction that is directly vertical over interconnection structure 10/10' can render interconnection structure 10/10' inadequate for a suspension point. Thus, a bracket can be attached to an elongate structural member adjacent to interconnection structure 10/10', thereby allowing a suspension connector to get proper attachment to a nearby beam. The angle between the suspension connector and vertical allows for the suspension connector to be either non-vertical, or slightly off of vertical.

It should be appreciated that the modular space frame support system (and resulting work platform system) described herein are only intended as examples and the present disclosure is intended to encompass numerous variations of the above-described modular space frame support system and work platform system, components thereof, and/or methods of assembly. For example, while the modular space frame support system and work platform system described herein include two levels 110, 120, in other embodiments, there can be other numbers of levels.

The particular shapes of the different structures of a given modular space frame support system and work platform system can also vary depending on the use of the modular space frame support system and, if used as a work platform system, the size, shape and location of a structure being accessed using the work platform system. For example, depending on the embodiment, the various levels of the modular space frame support system and work platform system can take on any of a variety of rectangular, triangular, or other polygonal shapes (further for example, the octagonal, hexagonal, etc.) or even possibly shapes other than polygonal shapes, and further, the individual units or sections of a modular space frame support system and, ultimately, work platform system likewise can take on any variety of rectangular, triangular, or other polygonal shapes.

The materials out of which the modular space frame support system and work platform system can be formed can vary depending on the embodiment. For example, suitable materials for components of such modular space frame support systems and work platform systems include, but are not limited to, metal (e.g., steel, aluminum, etc.), wood, plastic, composite, or other suitable material. Also, such components can be made of items that are solid, corrugated, grated, smooth, or of other suitable configurations. For example, work platforms 50 of such work platform systems can be made of wood sheeting, plywood, roof decking material, metal on a frame, grating, steel sheeting, and the like, among other things. Also, it should be appreciated that a variety of types of linkages can be employed in supporting the levels of the modular space frame support system and work platform system relative to the other levels and/or relative to another support structure.

As referenced above, in at least some embodiments, a modular space frame support system and work platform system are advantageous in that, because the frame units are formed from multiple discrete components such as the interconnection structures, elongate structural members, chords and associated work platforms, worker(s) can modify or add to existing portions of the modular space frame support system and work platform system while physically supported upon an existing, installed section or unit of a modular space frame support system or work platform system. In at least some embodiments, worker(s) in such circumstance can extend, relocate, or remove components of the modular space frame support system and work platform system using only hand tools, and no mechanical tools, hoists, cranes, or other equipment is required to add to, or subtract from, existing units of the modular space frame support system or work platform system.

Although not discussed above, in other embodiments, other types of components can also be included in a modular space frame support system and work platform system. For example, in some embodiments, tarps or sheeting or the like can be attached to railings or an upper or lower frame to enclose an area for various purposes.

Similarly, while the modular space frame support system and resulting work platform system can incorporate additional structural assemblies, such as, for example, supported scaffolding and other similar structures. Moreover, in some embodiments, additional frameworks or work platforms may be suspended from a level of a modular space frame support system.

Therefore, although certain embodiments of the present disclosure have been shown and described in detail above, it should be understood that numerous changes and modifications can be made without departing from the scope of the appended claims. Among other things, it should be appreciated that the scope of the present disclosure is not limited to the number of constituting components, the materials thereof, the shapes thereof, the relative arrangement thereof, etc., as described above, but rather the above disclosures are simply provided as example embodiments.

The modular space frame support system and resulting work platform system are now described with reference to the following non-limiting embodiments.

E1: A modular space frame support system comprising:

at least one unit of a modular space frame support system, the at least one unit comprising:

at least four elongate structural members, wherein a first and a second of the at least four elongate structural members form a first pair of opposed elongate structural members and a third and a fourth of the elongate structural members form a second pair of opposed elongate structural members, the first and second pairs of opposed elongate structural members joined together using at least four interconnection structures to define a substantially rectangular planar surface;

a plurality of diagonal chords attached to a respective one of each of the at least four interconnection structures at a first end and each connected to a single common interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to at least one of the first pair of opposed elongate structural members along first and second opposed edges, to one of the other of the pair of opposed elongate structural members, and the at least one further elongate structural member so as to at least partially cover the rectangular planar surface.

E2: The modular space frame support system of E1 comprising at least one vertical support.

E3: The modular space frame assembly of any of E1 and E2, wherein each of the at least four interconnection structures further includes at least one chord-engaging structure.

E4: The modular space frame support system of E3, wherein each of the at least one chord-engaging structure comprises two plates, wherein each plate contains an opening therethrough.

E5: The modular space frame support system of E4, wherein each of the two plates is arcuate.

E6: The modular space frame support system of E4, wherein each of the two plates is circular.

E7: The modular space frame assembly of any of claims E4-E6, wherein the two plates are non-symmetrical.

E8: The modular space frame assembly of any of E1-E7, wherein the respective first end of each of the plurality of diagonal chords and the respective second end of the plurality of diagonal chords each include two plates, each of the two plates containing an opening therethrough.

E9: The modular space frame assembly of any of E4-E7, wherein the respective first end of the plurality of diagonal chords and the respective second end of each of the plurality of diagonal chords includes two plates, each of the two plates containing an opening therethrough, and the distance between the two plates on the first and second ends of the plurality of diagonal chords is less than the distance between the respective two plates of the chord-engaging structures of each of the at least four interconnection structures.

E10: A modular space frame support system comprising:

at least two units of a modular space frame support system, each unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface;

a plurality of diagonal chords attached to a respective one of each of the at least four interconnection structures at a first end and each connected to at least one further interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to cover at least a portion of the rectangular planar surface, wherein the deck platform of each of the at least two units is coplanar, and wherein the plurality of diagonal chords of a first of the at least two units each have a length less than the plurality of diagonal chords of a second of the at least two units.

E11: The modular space frame support system of E10 comprising at least one vertical support.

E12: The modular space frame assembly of any of E10 and E11, wherein each of the at least four interconnection structures of each of the at least two units further includes at least one chord-engaging structure.

E13: The modular space frame support system of E12, wherein each of the at least one chord-engaging structure comprises two plates, wherein each plate contains an opening therethrough.

E14: The modular space frame support system of E13, wherein each of the two plates is arcuate.

E15: The modular space frame support system of E13, wherein each of the two plates is circular.

E16: The modular space frame assembly of any of E13-E15, wherein the two plates are non-symmetrical.

E17: The modular space frame assembly of any of E10-15, wherein the respective first end of each of the plurality of diagonal chords and the respective second end of each of the plurality of diagonal chords includes two plates, each of the two plates containing an opening therethrough.

E18: The modular space frame assembly of any of E13-15, wherein the respective first end of each of the plurality of diagonal chords and the respective second end of each of the plurality of diagonal chords includes two plates, each of the two plates containing an opening therethrough, and the distance between the two plates on the first and second ends of the plurality of diagonal chords is less than the distance between the respective two plates of the chord-engaging structure of each of the at least four interconnection structures of each of the at least two units.

E19: An interconnection structure comprising:

a first element being generally planar;

a second element being generally planar, wherein the first element and second element are generally parallel to one another; and a tubular section between the first element and second element, the tubular section having a hollow, smooth interior and providing a continuous passage through the first element and the second element.

E20: The interconnection structure of E19, further including a threaded cartridge comprising:

a tubular member having a threaded inner portion, a first outer portion which is smooth and a second outer portion having a securing structure-engaging structure; and a securing structure;

wherein the smooth outer portion has a length and outer diameter corresponding to a length and inner diameter of the tubular section such that, when the threaded cartridge is inserted into the tubular section, the second outer portion is exposed beyond one of the first element and second element to engage the securing structure.

E21: The interconnection structure of E19 or E20, wherein the tubular section has a substantially uniform cross-section along a length thereof.

E22: The modular space frame assembly of any of E1 and E9, wherein the at least four interconnection structures are in accordance with any of E19-E21.

E23: The interconnection structure of any of E19-E21 further comprising at least one chord-engaging structure.

E24: The interconnection structure of E23, wherein the at least one chord-engaging structure comprises two plates, wherein each plate contains an opening therethrough.

E25: The interconnection structure of E24, wherein each of the two plates is arcuate.

E26: The interconnection structure of E24, wherein each of the two plates is circular.

E27: The interconnection structure of any of E24-E26, wherein the two plates are non-symmetrical.

E28: A modular space frame support system comprising:

at least one unit of a modular space frame support system, the at least one unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface;

a plurality of diagonal chords attached to a respective one of each of the at least four interconnection structures at a first end and each connected to at least one further interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to at least partially cover the rectangular planar surface;

wherein each of the at least four interconnection structures comprise:

a first element being generally planar;

a second element being generally planar, wherein the first element and second element are generally parallel to one another; and a tubular section between the first element and second element, the tubular section having a hollow, smooth interior and providing a continuous passage through the first element and the second element.

E29: The modular space frame support system of E28, wherein each of the at least four interconnection structures further include a threaded cartridge comprising:

a tubular member having a threaded inner portion, a first outer portion which is smooth and a second outer portion having a securing structure-engaging structure; and a securing structure;

wherein the smooth outer portion has a length and outer diameter corresponding to a length and inner diameter of the tubular section such that, when the threaded cartridge is inserted into the tubular section, the second outer portion is exposed beyond one of the first element and second element to engage the securing structure.

E30: The modular space frame support system of E28 or E29, wherein the tubular section of each of the at least four interconnection structures has a substantially uniform cross-section along a length thereof.

E31: The modular space frame support system of any of E28-E30 comprising at least one vertical support.

E32: The modular space frame assembly of any of E28-E31, wherein each of the at least four interconnection structures further includes at least one chord-engaging structure.

E33: The modular space frame support system of E32, wherein each of the at least one chord-engaging structure comprises two plates, wherein each plate contains an opening therethrough.

E34: The modular space frame support system of E33, wherein each of the two plates is arcuate.

E35: The modular space frame support system of E33, wherein each of the two plates is circular.

E36: The modular space frame assembly of any of E33-E35, wherein the two plates are non-symmetrical.

E37: The modular space frame assembly of any of E28-E36, wherein the respective first end of each of the plurality of diagonal chords and the respective second end of each of the plurality of diagonal chords includes two plates, each of the two plates containing an opening therethrough.

E38: The modular space frame assembly of any of E33-E36, wherein the respective first end of each of the plurality of diagonal chords and the respective second end of each of the plurality of diagonal chords includes two plates, each of the two plates containing an opening therethrough, and the distance between the two plates on the first and second ends of the plurality of diagonal chords is less than the distance between the two plates of the chord-engaging structure of the at least four interconnection structures of the at least one unit.

E39: A modular space frame support system comprising:

at least two units of a modular space frame support system, each unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface;

a plurality of diagonal chords attached to a respective one of each of the at least four interconnection structures at a first end and each connected to at least one further interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to cover at least a portion of the rectangular planar surface, wherein the deck platform of each of the at least two units is coplanar, wherein the plurality of diagonal chords of a first of the at least two units each have a length less than the plurality of diagonal chords of a second of the at least two units, and wherein each of the at least four interconnection structures comprise:

a first element being generally planar;

a second element being generally planar, wherein the first element and second element are generally parallel to one another; and a tubular section between the first element and second element, the tubular section having a hollow, smooth interior and providing a continuous passage through the first element and the second element.

E40: The modular space frame support system of E39, wherein each of the at least four interconnection structures further include a threaded cartridge comprising:

a tubular member having a threaded inner portion, a first outer portion which is smooth and a second outer portion having a securing structure-engaging structure; and a securing structure;

wherein the smooth outer portion has a length and outer diameter corresponding to a length and inner diameter of the tubular section such that, when the threaded cartridge is inserted into the tubular section, the second outer portion is exposed beyond one of the first element and second element to engage the securing structure.

E41: The modular space frame support system of E39 or E40, wherein the tubular section of each of the at least four interconnection structures has a substantially uniform cross-section along a length thereof.

E42: The modular space frame assembly of any of E39-E41, wherein each of the at least four interconnection structures further include at least one chord-engaging structure.

The invention claimed is:

1. A modular space frame support system comprising:

at least one unit of a modular space frame support system, the at least one unit comprising:

at least four elongate structural members, wherein a first and a second of the at least four elongate structural members form a first pair of opposed elongate structural members and a third and a fourth of the elongate structural members form a second pair of opposed elongate structural members, the first and second pairs of opposed elongate structural members joined together using at least four interconnection structures to define a substantially rectangular planar surface;

wherein each interconnection structure comprises:

a first element being generally planar and a second element being generally planar, wherein the first element and the second element are generally parallel to one another;

a tubular section between the first element and the second element, the tubular section having a hollow, generally smooth interior and providing a continuous passage through the first element and the second element; and a cartridge comprising:

a securing structure aligned with the tubular section; and a member at least partially inserted into the tubular section, wherein a portion of the member is exposed beyond one of the first element or the second element to engage the securing structure;

a plurality of diagonal chords attached to a respective one of each of the at least four interconnection structures at a first end and each connected to a single common interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to at least one of the first pair of opposed elongate structural members along first and second opposed edges, to one of the other of the pair of opposed elongate structural members, and the at least one further elongate structural member so as to at least partially cover the rectangular planar surface.

2. The modular space frame support system of claim 1, wherein each of the at least four interconnection structures further include at least one chord-engaging structure.

3. The modular space frame support system of claim 2, wherein each of the at least one chord-engaging structure comprises two plates, wherein each plate contains an opening therethrough.

4. The modular space frame support system of claim 3, wherein each of the two plates is at least partially arcuate.

5. The modular space frame support system of claim 3, wherein each of the two plates is at least partially circular.

6. The modular space frame support system of claim 3, wherein the two plates are non-symmetrical.

7. The modular space frame support system of claim 1, wherein the respective second end of the plurality of diagonal chords each include two plates, each of the two plates containing an opening therethrough.

8. The modular space frame support system of claim 3, wherein the respective first end of the plurality of diagonal chords and the respective second end of each of the plurality of diagonal chords includes two plates and a distance between the two plates on the first and second ends of the plurality of diagonal chords is less than the distance between the respective two plates of the chord-engaging structures of each of the at least four interconnection structures.

9. A modular space frame support system comprising:

at least two units of a modular space frame support system, each unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface;

wherein each interconnection structure comprises:

a first element being generally planar and a second element being generally planar, wherein the first element and the second element are generally parallel to one another;

a tubular section between the first element and the second element, the tubular section having a hollow, generally smooth interior and providing a continuous passage through the first element and the second element; and a cartridge comprising:

a securing structure aligned with the tubular section; and a member at least partially inserted into the tubular section, wherein a portion of the member is exposed beyond one of the first element or the second element to engage the securing structure;

a plurality of diagonal chords attached to a respective one of each of the at least four interconnection structures at a first end and each connected to at least one further interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to cover at least a portion of the rectangular planar surface, wherein the deck platform of each of the at least two units is coplanar, and wherein the plurality of diagonal chords of a first of the at least two units each have a length less than the plurality of diagonal chords of a second of the at least two units.

10. The modular space frame support system of claim 9, wherein each of the at least four interconnection structures of each of the at least two units further includes at least one chord-engaging structure.

11. The modular space frame support system of claim 10, wherein each of the at least one chord-engaging structure comprises two plates, wherein each plate contains an opening therethrough.

12. The modular space frame support system of claim 11, wherein each of the two plates is at least partially arcuate.

13. The modular space frame support system of claim 11, wherein each of the two plates is at least partially circular.

14. The modular space frame support system of claim 11, wherein the two plates are non-symmetrical.

15. The modular space frame support system of claim 9, wherein the respective first end of each of the plurality of diagonal chords and the respective second end of each of the plurality of diagonal chords includes two plates, each of the two plates containing an opening therethrough.

16. The modular space frame support system of claim 11, wherein the respective first end of each of the plurality of diagonal chords and the respective second end of each of the plurality of diagonal chords includes two plates and a distance between the two plates on the first and second ends of the plurality of diagonal chords is less than the distance between the respective two plates of the chord-engaging structure of each of the at least four interconnection structures of each of the at least two units.

17. An interconnection structure comprising:

a first element being generally planar;

a second element being generally planar, wherein the first element and second element are generally parallel to one another;

a tubular section between the first element and second element, the tubular section having a hollow, generally smooth interior and providing a continuous passage through the first element and the second element; and a cartridge comprising:

a securing structure aligned with the tubular section; and a member at least partially inserted into the tubular section, wherein a portion of the member is exposed beyond one of the first element or the second element to engage the securing structure.

18. The interconnection structure of claim 17, wherein the tubular section has a substantially uniform cross-section along a length thereof.

19. The interconnection structure of claim 17 further comprising at least one chord-engaging structure.

20. The interconnection structure of claim 19, wherein the at least one chord-engaging structure comprises two plates, wherein each plate contains an opening therethrough.

21. The interconnection structure of claim 20, wherein each of the two plates is at least partially arcuate.

22. The interconnection structure of claim 20, wherein each of the two plates is at least partially circular.

23. The interconnection structure of claim 20, wherein the two plates are non-symmetrical.

24. A modular space frame support system comprising:

at least one unit of a modular space frame support system, the at least one unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface;

a plurality of diagonal chords attached to a respective one of each of the at least four interconnection structures at a first end and each connected to at least one further interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to at least partially cover the rectangular planar surface;

wherein each of the at least four interconnection structures comprise:

a first element being generally planar;

a second element being generally planar, wherein the first element and second element are generally parallel to one another;

a tubular section between the first element and second element, the tubular section having a hollow, generally smooth interior and providing a continuous passage through the first element and the second element; and a cartridge comprising:

a securing structure aligned with the tubular section; and a member at least partially inserted into the tubular section, wherein a portion of the member is exposed beyond one of the first element or the second element to engage the securing structure.

25. The modular space frame support system of claim 24, wherein the tubular section of each of the at least four interconnection structures have a substantially uniform cross-section along a length thereof.

26. The modular space frame support system of any of claims claim 24, wherein each of the at least four interconnection structures further includes at least one chord-engaging structure.

27. The modular space frame support system of claim 26, wherein each of the at least one chord-engaging structure comprises two plates, wherein each plate contains an opening therethrough.

28. The modular space frame support system of claim 27, wherein each of the two plates is at least partially arcuate.

29. The modular space frame support system of claim 27, wherein each of the two plates is at least partially circular.

30. The modular space frame support system of claim 27, wherein the two plates are non-symmetrical.

31. The modular space frame support system of claim 24, wherein the respective first end of each of the plurality of diagonal chords and the respective second end of each of the plurality of diagonal chords includes two plates, each of the two plates containing an opening therethrough.

32. The modular space frame support system of claim 27, wherein the respective first end of each of the plurality of diagonal chords and the respective second end of each of the plurality of diagonal chords includes two plates and a distance between the two plates on the first and second ends of the plurality of diagonal chords is less than the distance between the two plates of the chord-engaging structure of the at least four interconnection structures of the at least one unit.

33. A modular space frame support system comprising:

at least two units of a modular space frame support system, each unit comprising at least four elongate structural members, wherein a first and a second of the at least four elongate structural members forms a first pair of opposed elongate structural members and a third and a fourth of the elongate structural members forms a second pair of opposed elongate structural members, the first and second pairs of opposed elongate structural members joined together using at least four interconnection structures to define a substantially rectangular planar surface;

a plurality of diagonal chords attached to a respective one of each of the at least four interconnection structures at a first end and each connected to a at least one further interconnection structure at a second end;

at least one further elongate structural member connected to and extending between one of the first pair of opposed elongate structural members and the second pair of opposed elongate structural members in a direction perpendicular to the one of the first pair of opposed elongate structural members and the second pair of opposed elongate structural members; and at least one deck platform secured to the at least two elongate structural members and the at least one further elongate structural member so as to cover at least a portion of the rectangular planar surface, wherein the deck platform of each of the at least two units is coplanar, wherein the plurality of diagonal chords of a first of the at least two units each have a length less than the plurality of diagonal chords of a second of the at least two units, and wherein each of the at least four interconnection structures comprise:

a first element being generally planar;

a second element being generally planar, wherein the first element and second element are generally parallel to one another;

a tubular section between the first element and second element, the tubular section having a hollow, generally smooth interior and providing a continuous passage through the first element and the second element; and a cartridge comprising:

a securing structure aligned with the tubular section; and a member at least partially inserted into the tubular section, wherein a portion of the member is exposed beyond one of the first element or the second element to engage the securing structure.

34. The modular space frame support system of claim 33, wherein the tubular section of each of the at least four interconnection structures have a substantially uniform cross-section along a length thereof.

35. The modular space frame support system of claim 33, wherein each of the at least four interconnection structures further include at least one chord-engaging structure.

* * * * *